US006237556B1

(12) United States Patent
Smith et al.

(10) Patent No.: US 6,237,556 B1
(45) Date of Patent: May 29, 2001

(54) ROTARY VALVE FOR INTERNAL COMBUSTION ENGINES

(75) Inventors: Brian Smith, St Leumeah; Wayne Smith, Drance, both of (AU)

(73) Assignee: Rovasco Pty Ltd., Sydney NSW (AU)

( * ) Notice: Subject to any disclaimer, the term of this patent is extended or adjusted under 35 U.S.C. 154(b) by 0 days.

(21) Appl. No.: 09/462,023

(22) PCT Filed: Jul. 3, 1998

(86) PCT No.: PCT/AU98/00514

§ 371 Date: Mar. 20, 2000

§ 102(e) Date: Mar. 20, 2000

(87) PCT Pub. No.: WO99/01644

PCT Pub. Date: Jan. 14, 1999

(30) Foreign Application Priority Data

Jul. 4, 1997 (AU) ..... P07707

(51) Int. Cl.[7] ..... F01L 7/16
(52) U.S. Cl. ..... 123/190.8
(58) Field of Search ..... 123/190.4, 190.6, 123/190.8, 190.1, 190.17, 190.16, 190.2

(56) References Cited

FOREIGN PATENT DOCUMENTS

WO 97/11261 * 3/1997 (WO) .

* cited by examiner

*Primary Examiner*—Noah P. Kamen
*Assistant Examiner*—Hyder Ali
(74) *Attorney, Agent, or Firm*—Bliss McGlynn, P.C.

(57) ABSTRACT

A rotary valve for an internal combustion engine includes a cylindrical valve rotor having an inlet and an outlet port arranged in the circumferential surface thereof, and a plurality of sealing elements mounted on the valve rotor such as to subdivide the circumferential surface of the rotor body to define discrete circumferential surface zones thereon, a predetermined one of the discrete surface zones being arranged such that, when the rotary valve is received within a valve bore in a cylinder head of an engine and the sealing elements of the rotary valve abut on the valve bore surface, it periodically seals-off a transfer port in the cylinder head, for which the rotary valve serves as closing and opening, during at least part of the compression and combustion strokes performed in the engine, whereby air-fuel mixture compressed during the compression stroke and combustion gases created during combustion stroke are substantially prevented from passing into the inlet or outlet port of the valve during these strokes.

28 Claims, 10 Drawing Sheets

90 (80)
92 (82)
96
95 (85)
92 (82)

98
91 (81)
92
93
97
99
91 (81)

52
15
92 (82)
95 (85)
16
98 (88)
92 (82)
44
12
90 (80)
97
67
94 (84)
99
66
b
c
65
93 (83)
96 (86)
94 (68)

ROTARY VALVE FOR INTERNAL COMBUSTION ENGINES

FIELD OF THE INVENTION

The present invention relates to rotary valves for internal combustion engines. In particular, the present invention concerns sealing systems employed to minimise gas leakage problems present with rotary valve types having a cylindrical valve rotor which rotates with a predetermined radial clearance within a receiving bore of the engine.

BACKGROUND OF THE INVENTION

Different types of rotary valves for internal combustion engines have been known since the early days of conception of such engines as an alternative to poppet type valves to selectively and periodically enable and prevent flow of intake fluids and exhaust gases through a transfer port leading to a combustion chamber of the engine.

The potential advantages which use of rotary valves can provide as compared to conventional poppet type valves are well documented and include improved smoothness of operation, rapid and precise opening and closing of transfer ports, reduction or inhibition of intake-exhaust overlap and the larger port opening sizes that can be provided to achieve higher volumetric ratios of fluid transfer into/from the combustion chamber. The major drawback in their practical implementation is the hitherto unsatisfactorily resolved sealing problems.

In the following, rotary valves will be described in the context of their use with reciprocating type internal combustion engines. However, neither some of the known nor the rotary valve embodiments in accordance with the present invention are limited to such applications. They may find equal use with other type of engines, such as rotary piston engines (Wankel motor), in which combustion energy is transformed into mechanical power in an intermittent operating cycle of the engine. The operating cycle, as used herein, encompasses the induction of a working fluid (air, fuel) into, compression and subsequent ignition of the working fluid within, expansion of resultant combustion gases within and exhaustion of combustion gases from a combustion chamber of the engine. These are also referred to below as the operating phases or strokes (in the case of reciprocating type engines) of the engine.

One such rotary valve type broadly consists of a cylindrical shaped rotor body which is coaxially supported for rotation within a valve bore formed in the cylinder head of the engine. Gas exchange ports formed on the peripheral surface of the rotor body periodically align with an associated transfer port opening in the bore and which leads to a combustion chamber of the engine. Examples of such valves include valve rotors with radial gas flow only, in which one or more gas exchange ducts have diametrically opposing ports in an otherwise continuos peripheral surface (see eg U.S. Pat. No. 4,019,499), and valve rotors with "axial—radial gas flow" having two gas exchange ducts commencing on opposite axial side faces of the valve rotor and extending therethrough so as to respectively terminate in an intake and an exhaust port in the peripheral surface of the rotor body (see eg U.S. Pat. No. 5,052,349). Rotary valves can be equally employed for two and four stroke engines, specific layout of the gas transfer ducts and ports on the rotor being also dependant on the operating speeds of the rotor with respect to the crankshaft.

It is necessary to emphasise at the outset that the present invention is concerned with those types of rotary valve constructions in which the cylindrical rotor body is coaxially supported for rotation within the valve bore so as to maintain a relatively "small" radial clearance gap between the bore surface and the peripheral rotor body surface; "small" in this context is a 0.2 to 0.4 mm radial clearance gap which will ensure rotation of the rotor without risk of seizure within the bore and allows for manufacturing tolerances that are achievable without excessive costs.

Such rotary valves require a "seal system" arranged to define a frame around the transfer port which bridges and closes the radial gap so as to minimise gas leakage from the transfer port while the latter is to be maintained closed by the rotary valve, in particular during the ignition phase. This class of rotary valves is exemplified by the one disclosed in U.S. Pat. No. 4,852,532 ("the first Bishop patent"). The contents of this first Bishop patent is included herein by way of short hand cross reference, in particular in so far as it contains a succinct evaluation of some relevant prior rotary valve types and their relative drawbacks, see in particular column 3, line 56 to column 4, line 62.

In the rotary valve construction proposed in the first Bishop patent, a sleeve-like rotor has separate intake and exhaust ducts beginning in opposite axial side faces of the rotor body. The ducts respectively terminate in an inlet and exhaust port angularly spaced apart on the peripheral surface of the rotor body at the same axial location. The ports are dimensioned such that upon rotation of the valve rotor within the valve bore formed in the cylinder head of the engine, the inlet and exhaust ports periodically align with and pass over a single transfer port communicating the bore with the combustion chamber defined within the cylinder. The location and circumferential extension of the peripheral ports and herein between extending rotor surface zone, termed in Bishop "sealing zone", are chosen and dimensioned such that given a properly timed rotor revolution speed with respect to the operating cycle of the engine, gas passage to/from the transfer port is enabled through the intake and exhaust ports of the rotor body and prevented while the "sealing surface" covers the transfer port. In other words, specific or "discrete" zones on the periphery of the rotor body (including those surface zones which contain the ports) are "associable" with a respective one of the phases of the operating cycle, eg the same "discrete surface zone" of the rotor body always passes over and covers the transfer port during the exhaust, intake and combined compression and expansion phases.

In the first Bishop patent is disclosed a system of so-called "floating seals" which consists of two longitudinal sealing elements, rectangular in cross-section, which are received in grooves extending parallel with respect to the axis of rotation of the rotor and formed on either circumferential side of the transfer port within the bore surface. This axially extending sealing elements are loaded against the peripheral surface of the rotor body portion which includes the gas exchange ports, thereby to bridge the radial gap and prevent gas flow from the transfer port past the seals in circumferential direction of the rotor body. Such seals will hereinafter also be referred to as "seal elements against circumferential flow".

The seal elements against circumferential flow are abutted at either longitudinal end at a sealing ring respectively received within an annular groove formed on either axial side of the transfer port within the bore surface. The radially inward facing inner peripheral surface of the sealing rings sealingly rubs against the peripheral surface of the rotor body thereby to prevent gas flow from the transfer port past the sealing rings in axial direction of the rotor body. Such sealing rings will herein after also be referred to as "seal elements against axial flow".

The main function of the "floating seal frame" disclosed in the first Bishop patent is to prevent leakage of high pressure combustion gases primarily created during and subsequent the ignition phase of the operating cycle of the engine into the radial gap volume outside the framed transfer port, and thereby into the gas exchange ports of the rotor body and the axially adjoining rotor zones at which the rotor is supported in roller bearings. The effectiveness of the sealing system depends on the ability of the sealing elements against circumferential and axial flow to maintain a "closed" frame in particular during the critical compression, ignition and expansion phases. With the "seal frame" of the first Bishop patent this is not possible.

Due to manufacturing tolerances, assembly requirements and the nature of the sealing system employed, the width and depth of the annular grooves and of the longitudinal grooves will always need to be greater than the width and depth, respectively, of the respective sealing elements intended to be received therein. Thus, in case of the seal elements against circumferential flow, these will be received between the radially extending side surfaces of the longitudinal grooves with predetermined play in circumferential direction. This play is in itself not critical, since high pressure compression and combustion gases will tend to load the longitudinal seal elements in circumferentially opposite directions into sealing abutment against the groove side surfaces farthest from the transfer port, thereby creating an effective sealing band along the longitudinal groove.

However, in case of the seal elements against axial flow, the high pressure gases will bias the sealing rings in axially opposite directions away from the transfer port and against the radially extending side surfaces of the annular grooves farthest from the transfer port. This opens up the already existing gap between the longitudinal ends of the longitudinal seal elements and the hereto adjacent sealing rings, creating a "leakage path" for gases and fluids. Bearing in mind that the sealing rings maintain a radial clearance gap to the bottom of the annular grooves, a relevantly large leakage path cross section is created at the four seal element intersection points of the sealing frame. This leakage path cross section for each intersection is given by the product of the axial clearance gap between the axial end of the longitudinal sealing element and the respectively adjacent sealing ring (which in most cases would be equal to the difference between annular groove width and sealing ring width), and the radial extension (depth) of the sealing ring plus the product of the radial clearance gap between the bottom of the annular groove and the inner circumferential surface of the sealing ring and the width of the annular groove.

It can be demonstrated that the gas leakage rate from the combustion chamber past conventional piston sealing rings to the crankcase housing is directly proportional to the leakage path area given by the product of ring gap and radial clearance of the piston crown to the cylinder bore diameter. It can be further shown that the total leakage path area described above, on the basis of reasonable assumptions as to the clearance and tolerance values for above elements, to be in the order of twenty times the leakage path area of a conventional piston ring assembly of the piston reciprocating in the cylinder for which the rotary valve is to serve as closure means during the mentioned operating cycle phases of the engine. Thus, the overall gas leakage rate from the combustion chamber stemming from sealing system inadequacies of the rotary valve is potentially quite larger than is the case with conventional poppet type valves, where no such additional leakage is present.

This leakage in turn has a number of adverse effects on engine performance values. In case of an engine with carburettor type fuel delivery system, noticeable amounts of unburnt fuel can leak during the end phases of the compression stroke past the leakage zones in circumferential direction along the annular grooves into the radial gap outside the framed transfer port and into the exhaust port, thereby producing unwanted hydrocarbon emissions.

Further, the combustion flame proper can expand into the "crevices" underneath the seal elements (radial clearance gap which is always maintained between groove bottom and seal element) and between the seal elements when these are forced away at the intersection points. This not only can lead to unwanted combustion deposits on the sealing surfaces, which adversely affect the seal system in time, but also to flushing of only partly combusted charge mixture into the exhaust manifold system.

The above mentioned problems have been recognised and sought to tie addressed in PCT patent publication WO 94/11618 by Bishop (the second Bishop patent). There, a total of four sealing elements against axial flow and two sealing elements against circumferential flow are disposed about surround the transfer port. The sealing elements against circumferential flow are again received in corresponding longitudinal grooves formed in the bore surface on either circumferential side of the transfer port. In contrast to the first Bishop patent, the sealing elements against axial flow (sealing rings) are received in annular grooves formed in the circumferential surface of the rotor body on either axial side of the exchange ports. The sealing rings are preloaded with their radially outward facing circumferential surface to rub against the bore surface.

In one embodiment of the second Bishop patent, one annular groove is provided at either axial end of the rotor and two sealing rings are received with small axial play between them in each groove. Further, the sealing rings located closest to the transfer port have an arc segment with reduced depth. The length of this segment is equivalent to the distance in circumferential direction between the longitudinal sealing elements. That is, the sealing ring has an arc portion having an outer diameter which is smaller than the outer diameter in the non-recessed arc portion. The reduction in depth is by an amount equal to or greater than the radial clearance gap between the bore surface and the cylindrical main portion of the rotor, so that this arc portion does not rub against the bore surface. Rectangular indentations are disposed at each circumferential end of the reduced depth arc segment to accommodate the axially opposite ends of the longitudinal sealing elements; thus, these elements no longer abut with their terminal end faces on the radially extending side faces of the inner most rings, as is the case with the seals of the first Bishop patent, but rather the axially extending side faces that face away from the transfer port will circumferentially engage against the radially extending surfaces of the indentations to effect sealing.

This sealing system relies on the compression and in particular the ignition pressure to seal off gas leakage from the transfer port past the seals in axial and circumferential direction of the rotor by "subdividing" sealing functions. Instead of entirely confining high pressure gases into the rectangular transfer port zone framed by the "window of floating seals" of the first Bishop patent, these gases are now allowed to expand into the annular pressurising cavities defined at either axial end of the longitudinal seal elements and formed between the facing axial side surfaces of the two sealing rings, the outer circumferential surfaces of the sealing rings received in the groove, the side and bottom surfaces of the groove within which each ring pair is received with radial clearance to the groove bottom, and the surface of the bore against which the inner circumferential surfaces of the sealing rings rub. This expansion takes place through the reduced depth arc segment of the axially inner sealing rings. The high pressure biases the rings in axially opposite directions into sealing contact with the side surfaces of the annular groove as well as in radially outward direction thereby augmenting contact pressure of the outer circumferential surface of each ring against the bore surface.

The longitudinal seal elements are, as is the case in the first Bishop patent, biased in circumferentially opposite directions by the high pressure compression and combustion gases into sealing abutment against the groove side surfaces farthest from the transfer port, thereby creating an effective sealing band along the longitudinal groove with the exception of the intersection points between inner sealing rings and longitudinal sealing elements. This sealing mechanism is, therefore, intended to minimise circumferentially directed gas leakage along the rotor body surface toward the gas exchange ports.

Admittedly, the above described sealing system in accordance with the second Bishop patent suppresses gas leakage from the transfer port in axial outward direction past the axially outer, piston ring-type, sealing rings to that present at the ring gap. However, due to manufacturing tolerances and the inability to precisely juxtapose the longitudinal sealing elements (which are housed in the stationary bore) with respect to the axially inner sealing rings (which are housed in the rotating rotor), gas leakage gaps between the side surfaces of the longitudinal sealing elements received within the rectangular indentations of the inner sealing rings will still be present.

Of greater concern is that highly corrosive combustion gases and, as currently believed, combustion flames are permitted to enter the crevices formed by the annular pressurising cavities. The problems of potential deposits within the crevices and on surfaces intended to perform sealing functions is therefore still unaddressed.

SUMMARY OF THE INVENTION

The present invention has been devised with above mentioned problems in mind. Preferred embodiments of the present invention are also aimed at addressing other perceived problems as will be discussed bellow.

The present invention may be defined broadly as a rotary valve for an internal combustion engine, comprising a rotor housing having an axial bore and a transfer port arranged to provide fluid communication between the bore and a combustion chamber of the engine. The bore may advantageously be formed in the cylinder head of a reciprocating type engine for which the rotary valve is to replace conventional poppet type valves. A valve rotor is supported for rotation within the bore and has a cylindrical main body portion which maintains a predetermined small radial clearance gap to the bore surface. The main body portion has at least one fluid exchange duct terminating in an exchange port on an outer peripheral surface of the main body portion. In a preferred form, the main body portion comprises separate fluid intake and fluid exhaust ducts respectively commencing on axially opposite sides of the main body portion and terminating in an intake and an exhaust port which are spaced apart in circumferential direction on the outer peripheral surface of the main body portion, the circumferential surface area between the ports defining discrete transfer port sealing zones as discussed above.

The valve rotor is, in use of the rotary valve with the engine, arranged to be driven synchronously with the operating cycle of the engine such that the discrete surface zones of the main body portion associable with the compression and expansion phase of the operating cycle periodically cover the transfer port during said phases, and flow of intake and exhaust fluids into and from the combustion chamber is enabled during periodical overlapping of the transfer and exchange ports during the intake and exhaust phases of the operating cycle.

The rotary valve further includes a sealing system including a set of sealing rings disposed on axially opposite sides of the transfer and the exchange ports and received pairwise with predetermined axial play in respective single annular grooves formed preferably on the main body portion; however, the grooves could also be formed within the bore. All rings are dimensioned and arranged to protrude radially from said annular grooves, while allowing radial movement within the groove, so that either the radially outer or the radially inner circumferential surface of the rings (depending where the ring grooves are formed) is in substantially continuous sliding abutment against the bore surface or peripheral surface of the main body portion, as the case may be, thereby bridging said radial gap in circumferential direction of the rotor. If piston ring type sealing rings are employed, there will be a small ring gap, typically 0.25 mm, where the continuous abutment is interrupted; this is, however, not critical, as will be explained bellow.

The sealing system further includes two first longitudinal sealing elements received one each in a corresponding longitudinal groove formed either on circumferentially opposite sides close to the transfer port within the bore, but highly preferentially on circumferentially opposite sides of a discrete "ignition surface zone" of the main body portion which, in operation of the valve, covers the transfer port during the ignition phase of charge in the combustion chamber. "Ignition" is strictly speaking only that moment in which the spark plug is energised. However, because very high combustion pressures are generated during a relevant time interval in which the charge is combusted during which the engine crank shaft (and herewith rotationally synchronised valve rotor) covers part of its movement from shortly before top dead centre of piston movement towards bottom dead centre during the expansion phase (or stroke), the discrete ignition surface zone as herein referred to is more accurately defined as the rotor surface zone which covers the transfer port shortly before, during and a predetermined time period after actual ignition of charge takes place in the combustion chamber; that is, a time period surrounding maximum combustion pressure. The arc length of the circumferential rotor surface can be determined by the skilled engine designer to suit different operational needs, eg an arc surface sector equivalent to 20° to 35° rotation of the rotor is appropriate in most cases.

The first sealing elements, which extend parallel with the axis of rotation of the rotor, protrude radially from said longitudinal grooves into sliding abutment against the bore surface or peripheral surface of the main body portion, as the case may be, thereby bridging the radial gap in axial direction of the rotor. The first sealing elements have a length such as to be received between the sealing rings closest to the transfer port with a predetermined small axial clearance or play fit to cater for thermal expansion and contraction of the elements.

Finally, the rotary valve incorporates a pressurising system including a pressurised fluid source and conduits arranged and disposed such as to selectively direct an adequately pressurised fluid in between each ring pair thereby to bias, at least during the ignition phase, the rings in axially opposite directions to abut against a respectively adjacent side wall of the annular grooves in which the sealing ring pairs are received, substantially isolate the transfer port from the annular grooves during the ignition phase and substantially minimise fluid leakage during this phase from the gap cavity defined between those portions of the sealing rings closest to the transfer port and of the first sealing elements that bridge the radial gap, and the facing surfaces of the bore and the main body portion.

Essential to the present invention is that the two annular cavities which are each defined between the facing axial side surfaces of the two sealing rings received in a groove, the sealing ring circumferential surfaces located within the groove, the side and bottom surfaces of the groove bellow the circumferential surfaces of the rings (that is the radial clearance space to the groove bottom) and the surface of the bore against which the other circumferential surfaces of the sealing rings rub, are adequately pressurised to thereby prevent the high pressure ignition gases (and combustion flame) present in the gap volume over the transfer port during the ignition phase from breaking the seal (by moving the ring seals away from the annular groove side surfaces against which they sealingly abut). Thus, high pressure combustion gases are prevented from entering the crevices defined by these annular "pressurising" cavities, thereby avoiding above mentioned drawbacks.

It will also be appreciated that only the radially extending side face portions of the sealing rings that bridge the clearance gap between rotor and bore surface in the discrete ignition zone are directly exposed to the combustion flame and corrosive gases, as compared to the second Bishop sealing system where this gases and flame are permitted to enter the annular cavities thereby exposing the entire sealing rings to high thermal loads. Thus, the sealing rings of the pressurising system of the present invention are subjected to substantially lower thermal loads, thereby allowing to maintain lower tolerances to accommodate thermal expansion. Consequently, it is possible to employ piston type sealing rings with smaller ring end gaps, thereby reducing end gap leakage rates. Also, cooling requirements are reduced, and it is possible to use the pressurising fluid in effective manner to provide such cooling.

ADVANTAGEOUS EMBODIMENTS OF THE INVENTION

The layout and mechanics of the sealing rings and longitudinal sealing elements is, but for the points specifically addressed bellow, uncritical as far as the invention is concerned. Accordingly, different types of known sealing ring designs can be used. Whilst strictly speaking it is not essential to preload the sealing rings in radial direction so as to maintain sliding contact against the bore surface, because the sealing rings will be radially loaded by the pressurising means, this is advantageous. As with prior art valves, conventional piston type ring seals (or sealing rings), either with reduced ring end gap or overlapping ring ends, which due to their radial springiness inherently posses such radial preloading, are preferably used. The sealing rings can be made of materials other than conventional high temperature resistant spring steel. They do have to withstand lower operating temperatures than conventional piston rings but need to meet similar wear requirements; the rings can also be of "self lubricating" type. Alternative sealing ring types with a separate spring element to provide the radial bias are also known.

In order to prevent high pressure combustion gases from entering the annular pressurising cavities through the ring end gap in cases where conventional piston type sealing rings are used, the sealing rings closest to the transfer port will have to be fixed against rotation in an angular position in which the ring gap is outside the rotor surface zone associable with the ignition phase, preferably in the intake port area. This can be achieved using a pin member engaged into the ring gap or alternatively by ensuring that each ring has an appropriate cross-sectional aspect ratio (radial depth to width). This same considerations apply to the axially outer sealing rings. The advantage of fixedly locating the ring gaps in the area of the intake port are that potential leakage of gases past this gaps in axial direction away from the intake port will tend to be suppressed when intake manifold pressure is bellow the pressure level present on the axial ends of the rotor axially outside the annular seals. Any gases leaking into the intake port area will subsequently be redirected into the combustion chamber.

In order to facilitate introduction of the pressurising fluid in between the sealing ring pairs received within each groove, any suitable mechanism can be employed to prevent axial abutment of the facing ring side surfaces. Preferably, however, such "axial distance keeping means" should be provided by a separate element, so that the sealing rings need not be required to be mounted in a specific positional attitude to perform their sealing function. The separate axial distance keeping means are preferably arranged to bias the individual rings of each sealing ring pair in opposite axial directions so that their non-facing radially extending side faces abut against the respectively adjacent side wall surface of the annular groove in which they are received.

In one simple form thereof, such "axial biasing means" can assume the form of an undulated or conical spring washer. In a more elaborate form, a spreading ring can be arranged between the sealing rings in each groove, which is trapezoidal in radial cross-section, and which co-operates with the correspondingly shaped portions of the radially extending side faces of the sealing rings that face the spreading ring, thereby to simultaneously bias the sealing rings in radial and in axially opposite directions into sealing engagement with the valve bore surface and the side wall surfaces of the annular groove.

In the latter embodiment, it is possible to define a lubricant gallery channel between an outer circumferential surface of the expansion or spreading ring and facing channel side surfaces formed on the facing, radially extending side faces of the sealing rings, a plurality of circumferentially spaced apart lubricant feeding holes extending from the non-facing, radially extending side faces of the sealing rings to end in the lubricant gallery channel. This allows to introduce small lubricant quantities into the gallery (eg through a feeding bore in the cylinder head that leads into the valve bore at the gallery location) and from there through the feeding holes into the abutment zone between the sealing rings and the groove side wall surfaces, thereby minimising frictional wear and enhancing sealing efficiency.

As was mentioned above, a particularly preferred valve embodiment comprises a rotor design in which all sealing elements are housed within respective grooves formed on the main body portion of the rotor, this having the further adavantage of ease of mounting of the seals.

This latter type of sealing element arrangement has various advantages as compared to the seal arrangement of the second Bishop patent. In Bishop, because the seals against axial and circumferential flow are housed in different parts of the valve that move with respect to one another, very close manufacturing tolerances are required for the rotor bearings, the grooves on the rotor, the grooves within the rotor bore of the cylinder head, and the sealing elements (rings and longitudinal elements) if as close possible juxtaposed axial positioning of the rotor within the groove is to be achieved, bearing in mind the substantial thermal loads and forces (in particular during the combustion phase) to which the rotor is subjected, and in order to minimise gas leakage in circumferential direction at the seal intersection points. This adds substantially to manufacturing costs. On the other hand, with the preferred arrangement of seals in accordance with the invention, it is not necessary to provide seal element tolerances to accommodate small axial displacements the rotor is subject to within the groove (eg due to "thrust") to prevent seizing of interacting sealing elements at the intersection points; this tolerances potentially contribute to an increase in leakage path size. By arranging both the sealing elements against radial and axial flow on the rotor body, it is envisaged that the total gap size in axial direction of the rotor at the two intersection points each longitudinal sealing element has to the endwise axially adjoining sealing rings can be maintained between 0.015 and 0.025 mm, which is 1/10 of a typical piston ring gap size and a further magnitude smaller than the leakage path area of the first Bishop sealing system.

Also, this sealing element arrangement allows to address a potential problem of fluid cross contamination that exists with rotors which have a main body portion comprising separate fluid intake and fluid exhaust ducts respectively commencing on axially opposite sides of the main body portion and terminating in an intake and an exhaust port which are spaced apart in circumferential direction on the outer peripheral surface of the main body portion. Such fluid cross contamination can take place between the intake and exhaust ports in circumferential direction along the radial gap between rotor and bore surface. Thus, it is advantageous to include a plurality of second longitudinal sealing elements similar to the first sealing elements, each in a corresponding one of a plurality of additional longitudinal grooves on the peripheral surface of the main body portion, said second sealing elements disposed to provide a leading and a trailing sealing element for the intake port, a leading and a trailing sealing element for the discrete surface zone associable with the compression phase, the leading and the trailing sealing element for the discrete ignition surface zone being provided by said first sealing elements, an optional leading and a trailing sealing element for the discrete surface zone associable with the expansion phase, and a leading and a trailing sealing element for the exhaust port, thereby forming at least four discretely framed gap cavities associable with the operating phases of the engine which rotate with the rotor and which are in substance isolated from one another.

This concept (without the provision of pressurising means) is the subject of our earlier, published PCT patent application PCT/AU96/00593, the contents of which is incorporated by way of short hand cross reference, and reference should be made thereto for advantages which such construction and layout provides.

Advantageously, in order to minimise the number of longitudinal sealing elements, the trailing sealing element of the intake port, the trailing sealing element of the surface zone associable with the ignition phase and the trailing sealing element of the surface zone associable with the expansion phase are the same or provide the leading sealing element of the surface zone associable with the compression phase, the optional leading sealing element of the surface zone associable with the expansion phase and the leading sealing element of the exhaust port, respectively.

The longitudinal sealing elements preferably consist of rectangular or L-cross-sectionally shaped strips of spring steel material or a non-metallic material not requiring additional lubrication. The longitudinal grooves for the sealing elements will generally have a radial depth greater than the sealing elements so as to allow accommodation of a leaf spring to preload (bias) the sealing elements into surface contact against the rotor bore surface. It is self understood that the engagement surface radially protruding from the groove is radiused to provide planiform contact with the bore surface.

The annular pressurising cavities can be pressurised either periodically or continuously to an appropriate level in a number of ways and using a number of viable fluid sources to maintain sealing efficiency and exclude ingress of highly corrosive ignition and combustion gases into the pressurising cavities and past therefrom in axial direction of the rotor. Different options will now be presented with reference to the preferred valve design in which all sealing elements are housed within respective grooves formed on the main body portion of the rotor.

As compared with the second Bishop sealing system, where pressurisation of the annular cavity must follow the changing pressure levels present in the combustion chamber of the engine during the operating cycle (because the "pressurisation path" past the sealing rings closest to the transfer port is always open to the combustion chamber), with the arrangement of the present invention it is possible to make such pressurisation completely independent from the operating cycle. This can be achieved in a number of ways. One involves using a small, independent air compressor arranged to deliver directly or indirectly (via an intermediate accumulator) the required air amount at a predetermined pressure (see bellow) through appropriately dimensioned conduits in the cylinder head which communicate (via known moving part interface mechanisms) with appropriately located conduits in the rotor body leading into the annular cavities. Alternatively, compressed air sources otherwise present in the engine, such as turbo chargers or compressors which are used to ensure positive intake manifold pressure can be used as such sources.

The actual pressure level required to be present in the annular pressurising cavities will depend on the radial depth of the sealing rings, the radial clearance gap between rotor body and rotor bore surface and the peak ignition or combustion pressure present in the combustion chamber. The amount of air required to maintain an adequate pressure level will essentially depend on the leakage rate past the two ring gap ends (for piston sealing rings with end gap or overlapping ring ends) which itself is proportional to the pressure level. In particular, it can be shown that the pressure level required to maintain the sealing rings in surface abutment against the side walls of the annular grooves is equal to the maximum ignition pressure multiplied by the surface area ratio between the annular side surface area of the sealing ring that bridges the radial clearance gap between the rotor body and rotor bore surfaces and the entire annular side surface area of the sealing ring.

Assuming that the radial clearance gap values are small (eg 0.1 to 0.5 mm), the radial depth of the sealing ring is that of common piston rings (eg 4 to 6 mm) and the outer diameter of the sealing rings is large compared thereto (eg 50 to 120 mm), this ratio can be approximated to be equal to radial clearance gap over radial depth of the sealing ring.

Thus the required pressurising level can be adjusted within a relatively broad range of values by preselecting the radial clearance gap to sealing ring radial depth ratio. Since the radial clearance gap should be held at appropriately small values, it is the radial depth of the sealing elements (and groove depth) which is easiest adjusted. For example if the radial clearance gap is 0.2 mm and the radial depth of the sealing ring is chosen to be 5 mm, then the ratio will be 1 to 25. Assuming typical peak ignition pressure values to be between 70 and 75 bar, then pressurising cavity pressure levels of as low as 2.8 to 3.1 bar will suffice to ensure that the sealing rings maintain sealing contact against the groove side walls. It is clearly evident that this low pressure level is also advantageous in reducing friction induced wear on the radially engaging surfaces of the sealing rings at the valve bore. This level of pressure will also allow introduction of small oil amounts between sealing surfaces that are in contact during rotation of the rotor within the bore.

On the other hand, such pressurisation may not need to be constant and can be intermittent, as long as an appropriate pressurisation level is maintained during the critical ignition phase. This can be achieved in a number of ways. Having determined above that the pressurisation level required to ensure sealing contact of the rings against the groove side walls is rather low, the pressurised fluid source can be the cylinder of the engine during the compression phase, where pressure levels of up to 12 or more bar are present close to top dead centre ("TDC") of piston movement. This pressurised fluid source is advantageously used with injection type engines where the fuel is injected only very late close to TDC, so that the compressed air used to pressurise the annular cavities is substantially free of hydrocarbons.

To this end, at least one pressurising port of small area can be formed at an appropriate location in the discrete peripheral surface zone of the rotor body which covers (more precisely: passes over) the transfer port during the compression phase of the operating cycle (herein to follow also referred to as the "discrete compression surface zone"). The pressurising port is in fluid communication with the annular grooves in which the sealing rings are received through an internal conduit terminating in the groove bottom surface. The pressurising port (and herethrough flowing compression gases) will be subject to the same increasing pressure level present in the cylinder of the engine during the compression phase up to that moment in which the leading longitudinal sealing element of the discrete ignition surface zone clears the trailing edge of the transfer port, thereby cutting off further flow of gases in circumferential direction of the rotor from the transfer port into the discrete compression surface zone, whereby further flow of gases from the transfer port is now "compartmentalised" into the discrete ignition surface zone which is framed by the leading and trailing first longitudinal sealing elements (against circumferential gas leakage) and the sealing rings (against axial gas leakage). Thus, by appropriately locating the leading longitudinal sealing element of the discrete ignition surface zone on the rotor it is possible to determine the pressurisation level cut off point.

It will be appreciated that by arranging the longitudinal groove of the leading longitudinal sealing element of the discrete ignition zone such that it is in fluid communication with the annular grooves disposed at both axial ends thereof when the respective sealing elements are received therein, eg by machining the grooves to have the same radial depth, then this longitudinal groove can be used to provide the fluid and pressure transmission conduit to pressurise the annular pressurising cavities. In such case, however, the leading longitudinal sealing element of the discrete ignition surface zone should be provided by twin axial sealing blades, disposed to be received in parallel relationship with predetermined play in circumferential direction in the corresponding longitudinal groove on the main body of the rotor. The sealing blades are then preloaded or biased in circumferentially opposite directions, eg by means of an interposed leaf spring or the like, to maintain the blades in abutment against the respectively adjacent side wall of the longitudinal groove in which the sealing blade pair is received.

Accordingly, upon passing over the transfer port during the compression phase of the operating cycle, compression gases can flow into the zone between the facing radially extending surfaces of the blades and into the zone between the groove bottom and the lower surfaces of the blades received within the groove, from where it will flow in axial direction into the annular pressurising cavities, while simultaneously further biasing the axial blades in circumferentially opposite directions to be maintained in sealing surface abutment against the respective side wall surfaces of the longitudinal groove. This mechanism is similar to the pressurisation of the sealing rings. Thus a longitudinal pressurising cavity is formed and defined between the facing radially extending side surfaces of the axial blades received within the longitudinal groove, the circumferentially extending bottom surfaces of the axial blades located within the groove, the side wall surfaces of the groove bellow said blade bottom surfaces, the bottom surface of the groove and the surface of the valve bore against which the other circumferentially extending (outer) surfaces of the axial blades rub. This longitudinal pressurising cavity will be pressurised while the axial blade pair is passing over the transfer port.

As was discussed above, the pressurisation level required to maintain the axial blades (in particular the "trailing blade" closest to the transfer port) in abutment against the side wall surfaces of the groove against the ignition pressure present in the sealingly framed clearance gap volume over the discrete ignition surface zone is only a fraction of the ignition pressure. Thus, once the trailing axial blade clears the trailing edge of the transfer port, it will prevent ignition gases from entering the longitudinal groove and from there into the annular pressurising cavities.

Whilst there is a very small axial end gap at the points where the axial end faces of the axial sealing blades intersect (more appropriately: adjoin or meet) the radially extending side faces of the inner sealing rings (as was discussed above), and therefore a potential gas leakage path from sealingly framed clearance gap volume over the discrete ignition surface into the groove exists, it is believed that due to its small size, eg max 0.025 mm, which is 1/10 of that of a piston type sealing ring, the pressurisation of the longitudinal pressurising cavity, and the substantial gas flow velocities and pressure differentials present at and immediately following ignition, any potential leakage that could take place at this intersection points will not take place at all or almost spontaneously be cut off.

It is of course possible to isolate the axial flow paths formed within the longitudinal groves underneath the axial blades into the annular pressurising cavities by appropriately stepping the depth of the longitudinal groove at its axial ends so that the end cross section is fully covered by the adjoining axial side face of the sealing ring. In such case, however, the annular pressurising cavities will have to be pressurised through the pressurising port embodiment mentioned above or through another external source, as discussed above, or only the longitudinal groove in which the leading sealing element of the ignition surface zone is received (in which case no such stepping will be present at that groove only).

It is also possible to have all longitudinal sealing elements of the rotor body provided by twin axial sealing blades and have all longitudinal and the two annular grooves interconnected so as to provide a network of interconnected conduits that allow pressurisation of all the annular and longitudinal pressurising cavities (which thus form a pressurising cavity network) from an external source or the working cylinder. Assuming that piston type sealing rings with an end gap of 0.25 mm are used, that a total of twelve axial blades are employed, two pairs between the intake and exhaust ports (to minimise cross contamination during overlap), one pair as trailing sealing element after the intake port (=leading sealing element for compression phase), one pair as leading sealing element for the ignition surface zone (=trailing sealing element of compression phase), one pair as trailing sealing element for the ignition surface zone (=leading sealing element of expansion phase, optional) and one pair as leading sealing element for the exhaust port, and the total axial end clearance at each blade intersection point with an adjoining sealing ring to be 0.025 mm (total of 12 such points since total axial end clearance is assumed to be the mean value), then a total leakage of fifty two "leakage units" from the pressurising cavity network into its surrounding areas (assuming they are at a pressure below the cavities) is theoretically possible (one leakage unit being defined as the leakage that can take place through one axial end clearance gap). Further, assuming that the pressurising cavity network is sealingly pressurised as described above, the ring end gaps being outside the clearance gap volume above the ignition surface zone, then the theoretically possible leakage past the sealing elements against circumferential flow on either side of the ignition surface zone (disregarding above made comments that it is believed that no such leakage will take place in practice) is two leakage units of ignition and partly combusted gases. Accordingly, it may be preferential to use an external "clean" air source to pressurise the pressurising cavity network to a pressure level of say 4 bar, instead of the compression gases from within the cylinder, to achieve a considerable reduction of unburnt charge emissions.

It is of course also possible to only employ the twin axial blade and its pressurising system for the leading sealing element of the discrete ignition surface zone and the trailing sealing element of the expansion surface zone (=leading sealing element for the exhaust port) under omission of the intermediate sealing element (=leading sealing element of the expansion surface zone), and have the other sealing elements be single blades. Since the pressure differentials are not as significant and cross contamination problems not as serious, the usually employed circumferential side clearance tolerances of about 0.05 mm and the clearance gap values between groove bottom and bottom surface of the sealing blades of typically 0.5 to 0.6 mm together with the achievable axial clearance gap values of 0.015 to 0.025 mm may not adversely affect overall engine performance and emission values to an extent that the more elaborate pressurised twin sealing blade system need be used.

As will be appreciated in all the above embodiments of the pressurising system, the fluid used to pressurise the annular pressurising cavity and the longitudinal pressurising cavity between the twin blade sealing element is or can be maintained at a substantially lower temperature than the combustion gases (as used in the second Bishop patent) and therefore provides simultaneously an effective cooling system for the valve elements, which in turn allows for smaller tolerances for the axial and ring end clearance gaps.

The present invention and different aspects and advantages thereof will be more fully appreciated from the following description of preferred embodiments given with respect to the accompanying drawings, in which:

BRIEF DESCRIPTION OF THE DRAWINGS

FIGS. 7*a–c* show a plan, a side and a cross sectional enlarged view (not to scale), respectively, of a longitudinal sealing element shown in FIG. 3, wherein FIG. 7*c* shows the longitudinal sealing element received within its groove and interacting with the valve bore surface as indicated by circle VII in FIGS. 3 and 5;

DESCRIPTION OF PREFERRED EMBODIMENTS

Figure 1:
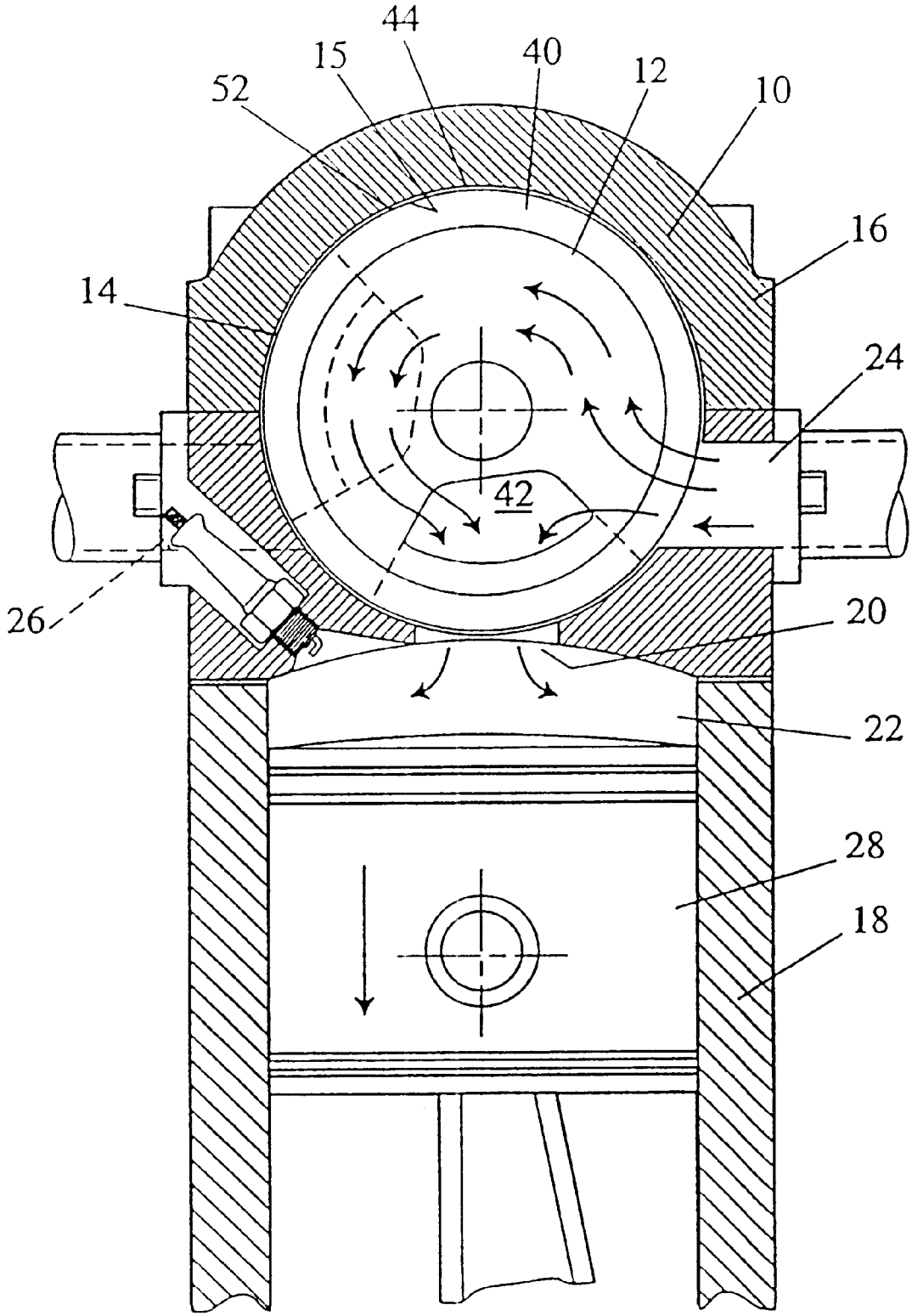
FIG. 1 shows a schematic cross-sectional side elevation through a rotary valve in accordance with a preferred embodiment of the invention in its application in a reciprocating type four stroke internal combustion engine.
Figure 2:
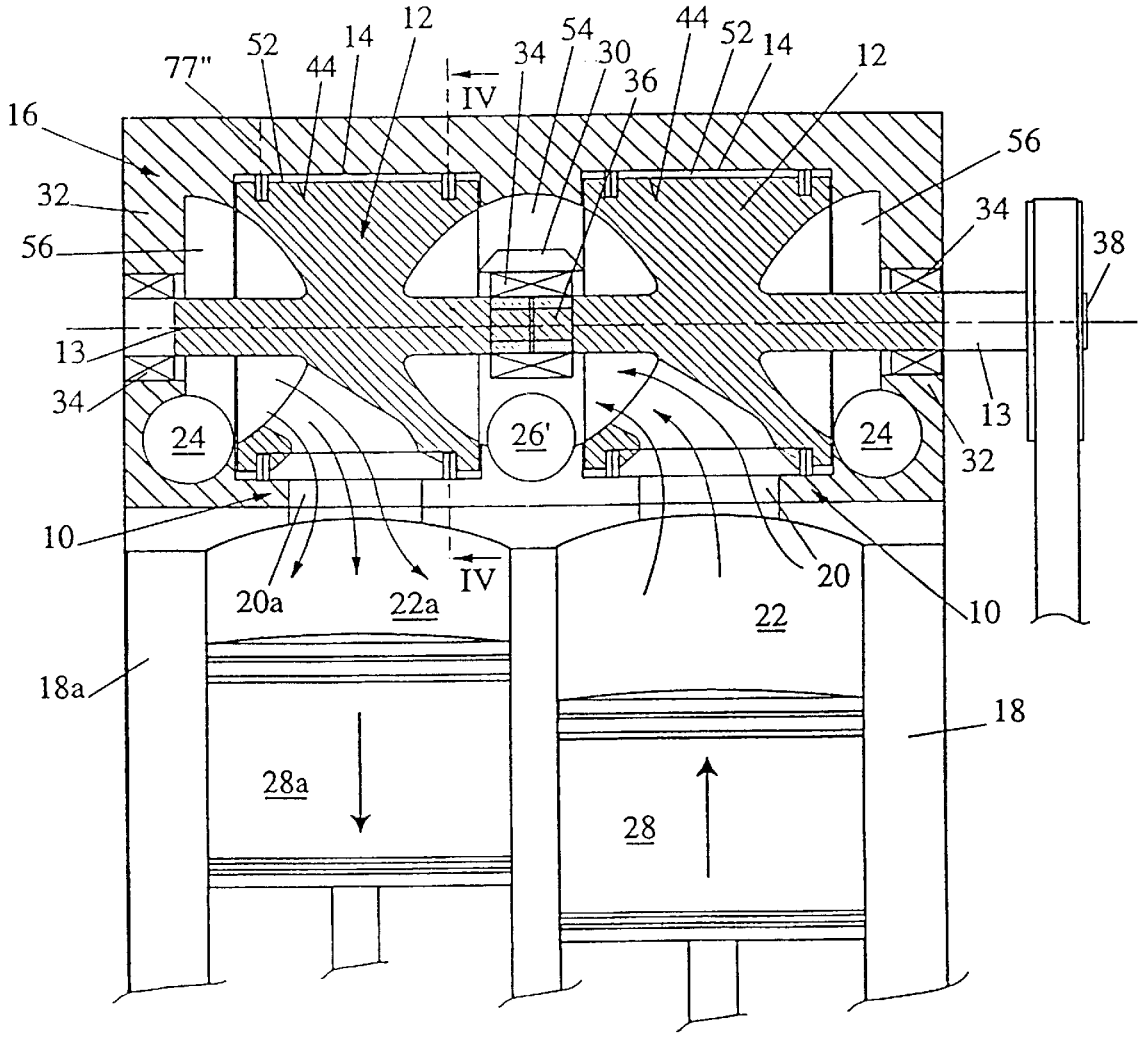
FIG. 2 shows a schematic longitudinal-sectional side elevation of a two cylinder internal combustion engine illustrating the arrangement of two rotary valves as shown in FIG. 1.

Referring first to FIGS. 1 and 2, there is schematically illustrated a rotary valve 10 comprising a valve rotor 12 which is supported for rotation in a valve bore 14 defined within an internal cavity of a cylinder head 16 of an internal combustion engine. The cross-section according to FIG. 1 is illustrative of a one, two or multi-cylinder internal combustion engine, FIG. 2 schematically showing the make-up of a two cylinder four stroke engine. There, two identical, co-axially arranged rotary valves 10 are provided, one per each engine cylinder 18, 18*a*, to respectively control the opening and closing of rectangular transfer ports 20, 20*a* of the cylinder head 16 which provide fluid communication between the combustion chambers 22, 22*a* of cylinders 18, 18*a* and intake and exhaust manifold channels 24, 26 formed in the cylinder head 16. Reciprocating pistons 28, 28*a* are arranged in cylinders 18, 18*a* to drive a crank shaft (not shown) of the engine in accordance with the operating cycle of the engine in known manner.

Cylinder head 16 is provided with suitably formed cooling fluid passages (not shown). Roller bearings 34, eg needle roller bearings, are mounted on a central bearing pedestal 30 formed within the cylinder head cavity and on lateral bearing pedestals formed in the side walls 32 of the cylinder head 16 which are arranged at both axial ends of valve bore 14, for rotatably supporting the axles 13 of both rotary valve rotors 12. In the multi-cylinder engine of FIG. 2, the axially adjoining rotary valve rotors 12 are coupled for synchronous rotation at their respective drive shafts by means of a suitable coupling journal, schematically illustrated at 36, which fixes the rotational position of the rotor bodies 12 with respect to one another. A conventional sprocket and chain assembly, indicated at 38, couples the crank shaft of the engine with the rotary valve(s) to ensure synchronised rotation of the valve rotor with the operating cycle of the engine which comprises an induction phase, a compression phase, a combustion or expansion phase and an exhaust phase in accordance with the stroke pattern of the piston 28, 28*a* in the respective cylinder 18, 18*a*.

For the rotary valve design illustrated in the accompanying figures, rotary valve rotation speed is set to half crank shaft rotation speed so that an exhaust and an intake port provided on the rotor body (see FIG. 3 and below) will pass over the transfer port 20 in the cylinder head 20 once during each revolution of the rotor 12, ie one full engine operating cycle.

Figure 3:
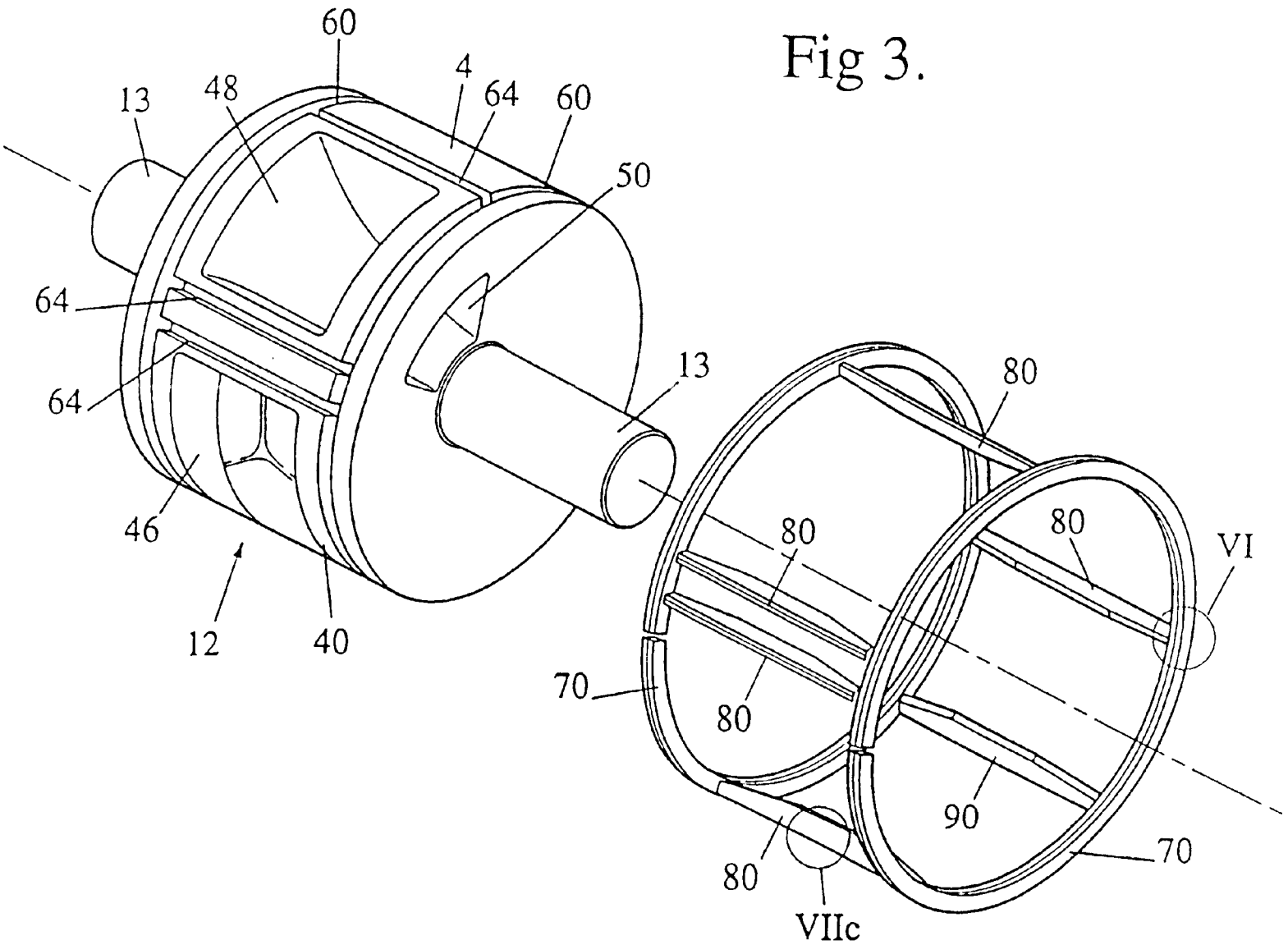
FIG. 3 shows an exploded orthogonal projection of the rotor body of the valve of FIG. 1, illustrating the sealing elements in their spatial relationship when received on the rotor body.

The rotor 12 of the rotary valve(s) 10 shown in FIGS. 1 and 2 is illustrated in FIG. 3. The rotor 12 comprises a main cylindrical body portion 40 having integrally formed the central load bearing shaft 13 extending from both axial end faces of the rotor main body portion 40. As best seen in FIGS. 2 and 3, each axial end face is recessed to form a central concave surface zone surrounding the shafts 13. The rotor main body portion 40 has a closed peripheral or circumferential surface 44 in which is formed a rectangular inlet port 46, which is in fluid communication via an inlet channel extending through the main body portion 40 with an inlet opening 42 in the recessed surface zone of one of the axial end faces (see eg FIG. 1). A rectangular exhaust port 48 is also formed on the circumferential surface 44 with angular spacing from the inlet port 46. The exhaust port 48 is in fluid communication via an exhaust channel extending through the main body portion 40 with an exhaust opening 50 formed in the recessed surface at the other one (opposite) axial end face (see FIG. 3). Turning back to FIGS. 1 and 2, the cylindrical rotor body 12 of rotary valve 10 is supported within the valve bore 14 to maintain a small radial clearance gap 52 between the peripheral (circumferential) surface 44 of the main body portion 40 and the interior surface 15 of the valve bore 14 circumferentially enclosing the rotor 12. The radial clearance gap 52 is provided, amongst other reasons, to accommodate differential thermal loads the rotary valve and the cylinder head are subjected to during operation of the engine and to inhibit seizing of the rotor body 12 within the valve bore 14. Radial clearance gap 52 also ensures that friction during rotation is limited to bearing point and sealing element friction. The radial clearance gap is set around 0.25 mm for the present embodiment, but can be larger, eg 0.45 mm.

Further, in the cylinder head for a multiple cylinder engine as illustrated in FIG. 2, the valve rotors 12 are received such that facing concave surfaces of adjoining valve rotors 12 form, together with the interposed valve bore zone where the rotary valves are jointly supported, an intake or exhaust chamber in the cylinder head 20 common to two valves; in the specific valve arrangement of FIG. 2, since the facing concave surfaces are those in which the exhaust channels of the respective valves open, the chamber acts as a common exhaust chamber 54 from which a single exhaust manifold channel 26 leads into the exhaust system of the engine. While not illustrated, similar considerations apply in forming a common intake chamber between adjoining rotary valves where the facing concave surfaces are those in which the inlet channels of the respective valves open. Two intake chambers 56 are formed at the axially opposite ends of the internal cavity of the cylinder head 16 between the concave recessed surfaces in which the respective inlet channels of the rotor valves open and the axial end side walls of the cylinder head 16 where the valves 10 are journaled at 34. An intake manifold channel 24 communicates with each intake chamber 56 and with an air intake system of the engine in known manner.

Figure 4:
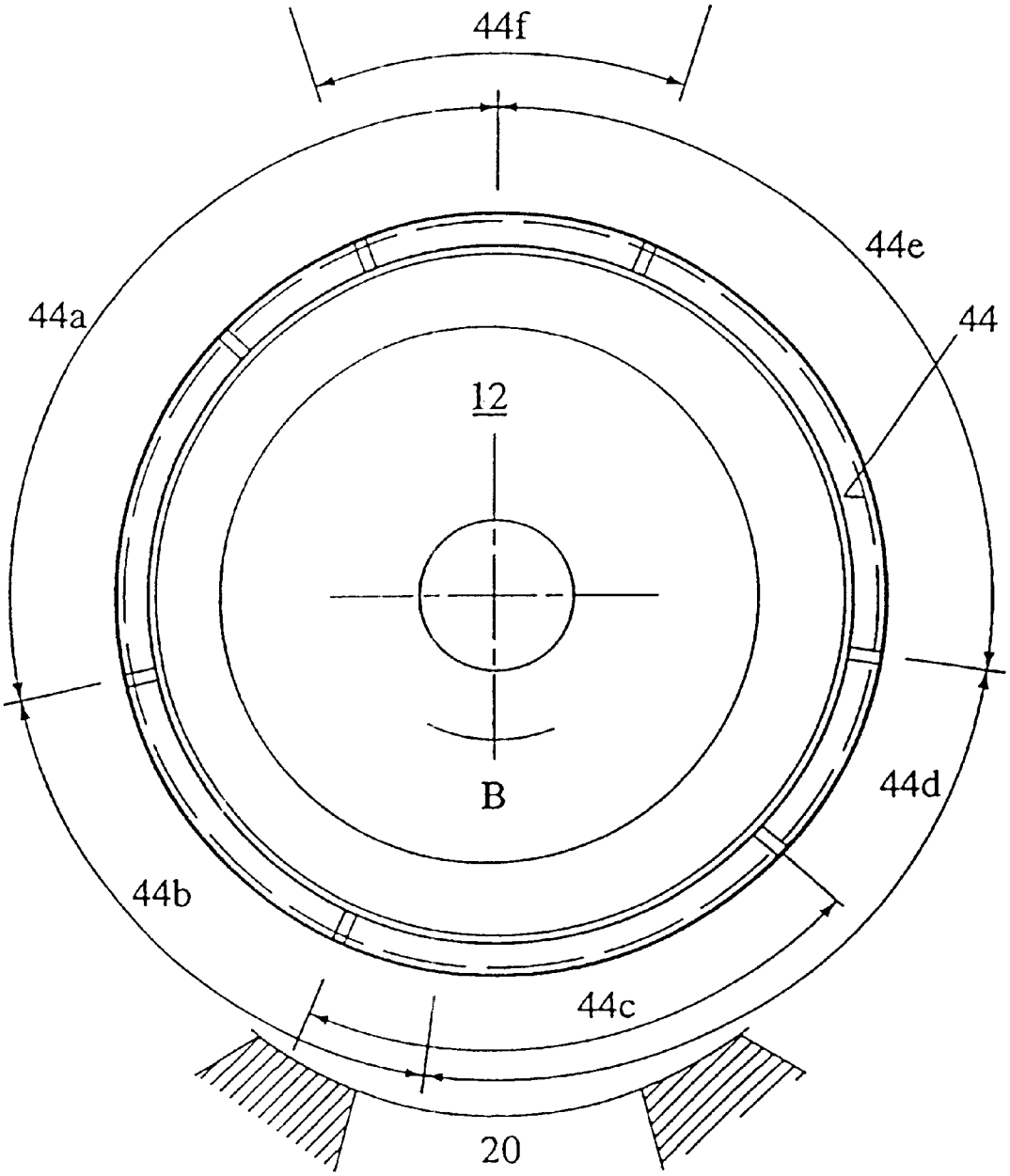
FIG. 4 is a schematic illustration of discrete surface zones on the rotor surface of the rotor shown in FIG. 3.
Figure 5:
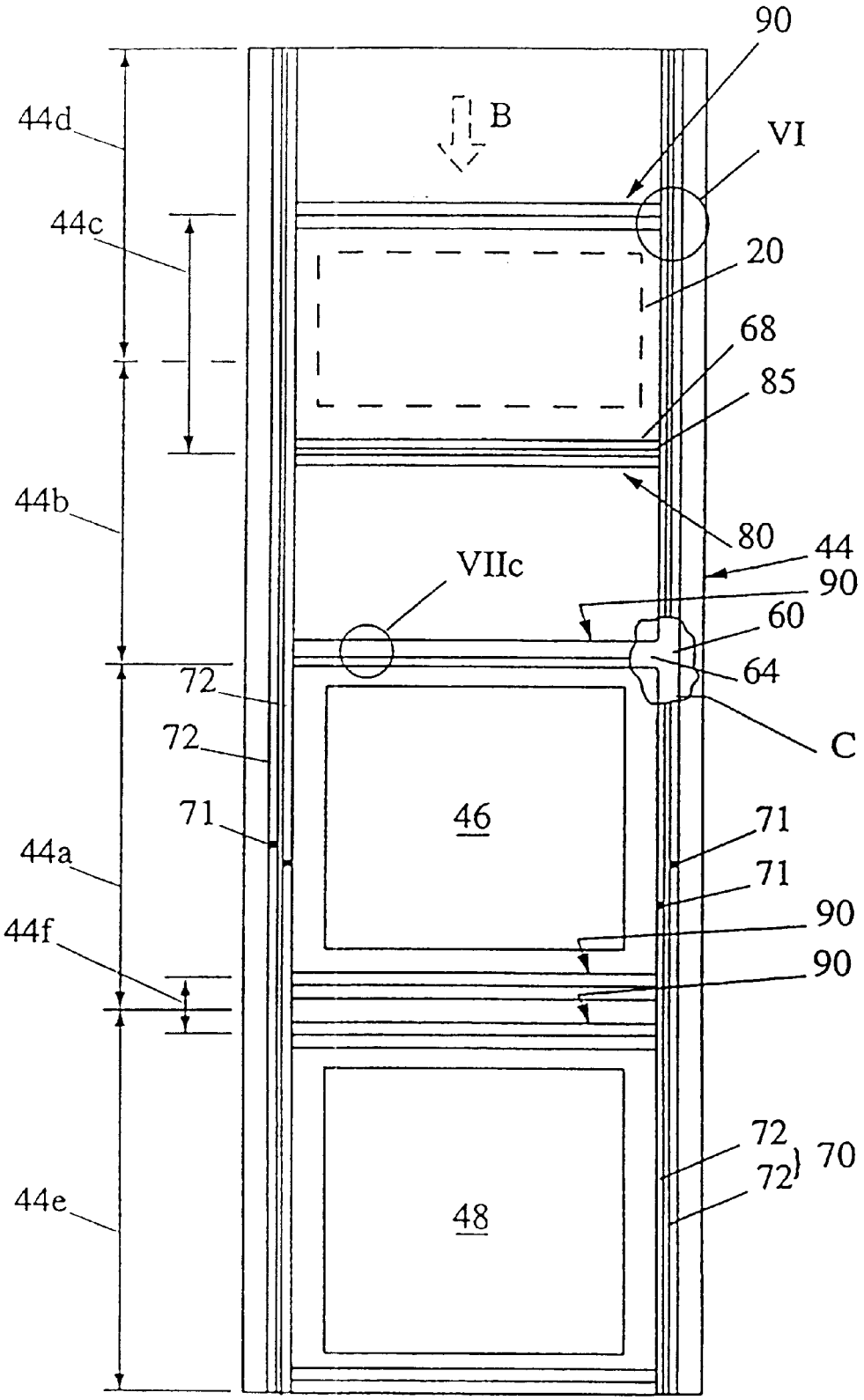
FIG. 5 illustrates a schematic developed view ("unwrapping") of the circumferential surface of the rotor of FIG. 3.

As has been described above, each rotary valve 10 is timed with the reciprocating movement (stroke) of the piston 28, 28*a* of the respectively associated cylinder 18, 18*a* to periodically allow gas passage through and seal-off the transfer port 20, 20*a*. Thus, discretely defined circumferential surface zones of the main body portion 40 are co-related to and can be said to be associated with a respective one of the strokes of the piston performed during one full engine operating cycle, i.e. the rotor body peripheral surface 44 can be notionally subdivided in an induction or intake, a compression, a combustion or expansion and an exhaust surface zone (indicated respectively at 44*a*, 44*b*, 44*d* and 44*e*, as is illustrated in FIG. 4 as well as in the "unwrapped illustration of the circumferential surface 44 of the rotor 12 illustrated in FIG. 5. In FIG. 5, the peripheral surface 44 appears as an elongated rectangle in which the rectangular intake and exhaust ports 46 and 48 are located in the discrete intake and exhaust surface zones 44*a* and 44*e*, a so called overlap surface zone 44*f* forming part of and being defined by adjoining portions of the intake and exhaust surface zones. The transfer port is illustrated in interrupted lines at and is traversed by the discrete surface zones as the rotor rotates (indicated by arrow B in FIGS. 4 and 5). It should be noted that the respective discrete zones are not illustrated in scale to one another but only to exemplify them; the length of the combined intake and exhaust surface zones 44*a* and 44*e*, however is greater than the combined compression and expansion surface zones 44*b* and 44*d*.

In FIG. 5, the transfer port 20 is momentarily situated opposite a discrete zone 44*c*, termed the ignition surface zone, which is defined by a small portion of the compression and a substantial portion of the combustion surface zones 44*b* and 44*d*. In operation of the valve 10 during rotation of the rotor 12, this ignition surface zone 44*c* covers the transfer port 20 during "the ignition phase" of charge in the combustion chamber in which peak pressures are present in the combustion chamber. These occur shortly before, at, during and a predetermined time period after actual ignition of charge takes place in the combustion chamber. Because high pressures are present during a substantial part of the expansion (or combustion) phase, the portion of the discrete combustion surface zone that forms part of the ignition surface zone may be substantial in practical implementation of the present invention as will become apparent.

Figure 10:
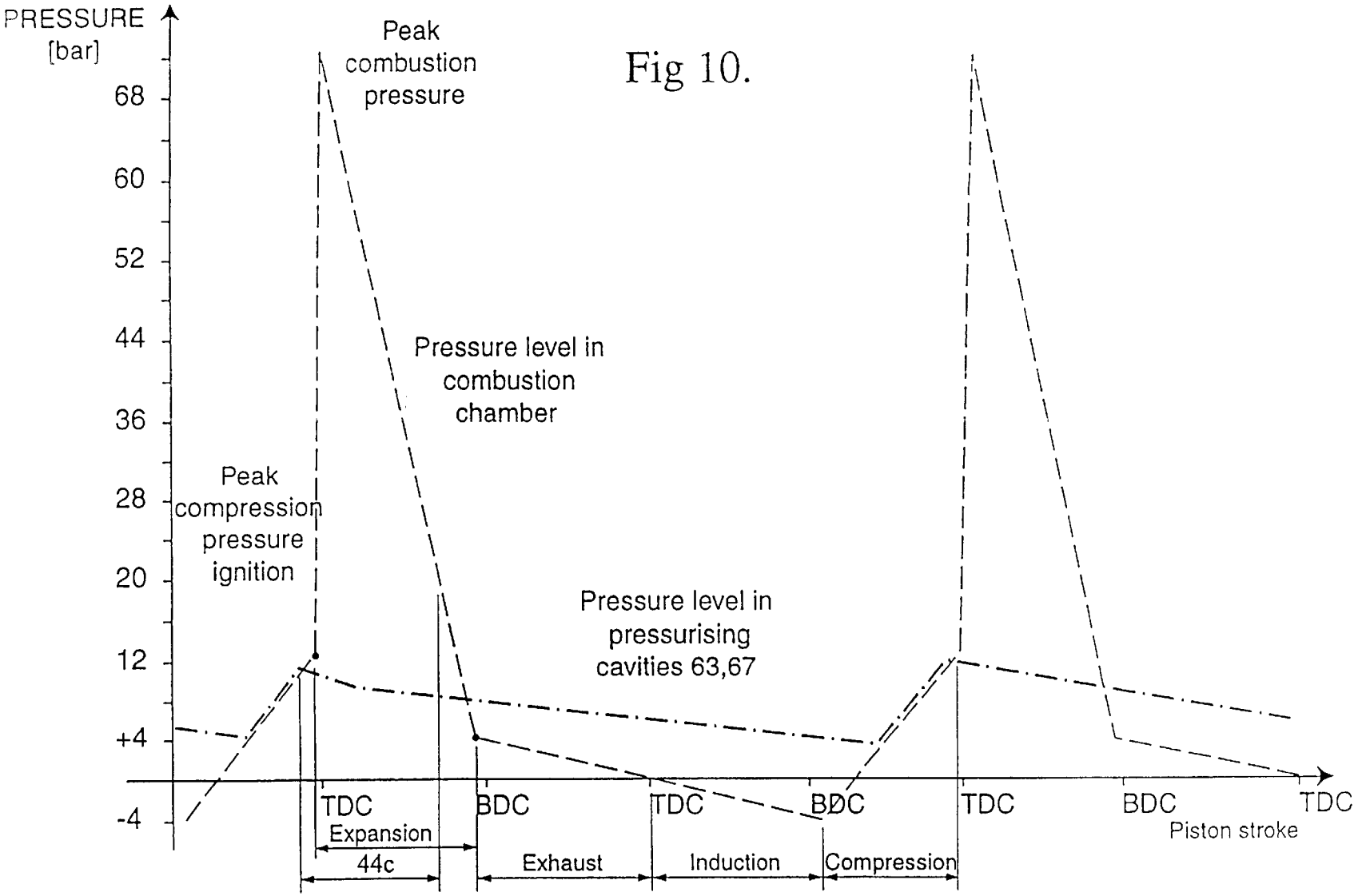
FIG. 10 shows an exemplary graph of the pressure level within the combustion chamber and the pressure level within the annular pressuring cavities of the rotor body vs the stroke sequence or operating phases of a four stroke internal combustion engine as shown in FIG. 1.

FIG. 10 contains a qualitative graph of the pressure levels present in the combustion chamber of a reciprocating type, four stroke operating cycle engine over the stroke sequence of the piston (interrupted line). It will be appreciated that the actual boundaries of the phases of the operating cycle do not coincide with bottom and top dead centre positions ("BDC" and "TDC") of piston movement, and lags and advances are present. As will be further noted, a substantial portion of the actual expansion phase is covered in the time period spaning the moment in which peak combustion pressure is present (achieved a very short time after actual ignition and within a few rotational degrees of crank shaft rotation after spark plug ignition before and after TDC) to the moment at which pressure drop has reached a pressure level somewhat above to that achieved during the compression phase. Accordingly, the predetermined time interval the discrete ignition surface zone is to cover the transfer port after actual ignition of the charge can be set to around the time interval required for pressure in the combustion chamber to fall from peak combustion pressure to a preselected expansion phase pressure level (in FIG. 10 illustrated at about 18 bar).This enables determination of the ignition surface zone 44*c*. Because rotor rotation speed is half crank shaft rotation speed, the arc length of the discrete circumferential ignition surface zone on the rotor surface can in practice span about 20° to 35° rotation of the rotor.

The above given value of 20° to 35° angle opening for the ignition surface sector is exemplarily and chosen only for the illustrated embodiment. It is evident that the specific circumferential length of the rotor surface which is to cover the transfer port during the above described pre-and-post ignition time window can also vary depending on the circumferential extension of the transfer port. The ignition surface zone will in any event have a circumferential length which is greater that the one of the transfer port in the cylinder head Referring back to FIGS. 1 to 5, in order to suppress gas flow from the transfer port (other than through the intake and exhaust ports of the valve rotor during the intake and exhaust phases) while it is to be maintained closed during the compression, ignition and expansion phases of the operating cycle, the rotor body 12 is provided with a number of sealing elements 70, 80, 90 and a pressurising system for the sealing elements as will be described herein bellow. The sealing elements are disposed such as to provide so-called sealing frames surrounding the above-referred to discrete surface zones (44*a* to 44*f*) of the rotor body 12. The sealing elements 70, 80, 90 are received in respective grooves 60, 64, 68 formed on the rotor surface 44 and arranged to bridge the radial clearance gap 52 and co-operate with the inside surface 15 of the valve bore 14 to create over each discrete surface zone discrete volume sectors that rotate with the rotor 12; in other words, the annular gap volume between the facing rotor and bore surfaces 44 and 15 is compartmentalised, thereby to substantially inhibit gas-flow between said framed volume zones.

As best seen in FIG. 3, the rotor body 12 has two circumferentially extending grooves 60 located on either axial side with distance from the edges of the intake and exhaust ports 46 and 48. In these annular grooves 60 are respectively positioned one pressurisable annular sealing element 70 arranged to prevent gas passage from the combustion chamber 22 through the transfer port 20 along the valve bore 14 in axial direction towards the exhaust and intake chambers 54 and 56 defined within the cylinder head 16 (FIG. 2).

In accordance with the invention each annular sealing element 70 consists of a pair of sealing rings, which in their simplest form can be piston type sealing rings as used for the pistons 28, 28*a*, with a small end gap (eg 0.15 mm) or stepped-overlapping ring ends (not shown). Two alternative embodiments of the annular sealing element 70 are illustrated in FIGS. 8*a* and b (see also FIG. 6) and 9*a* to *c*, respectively.

Figure 8B:
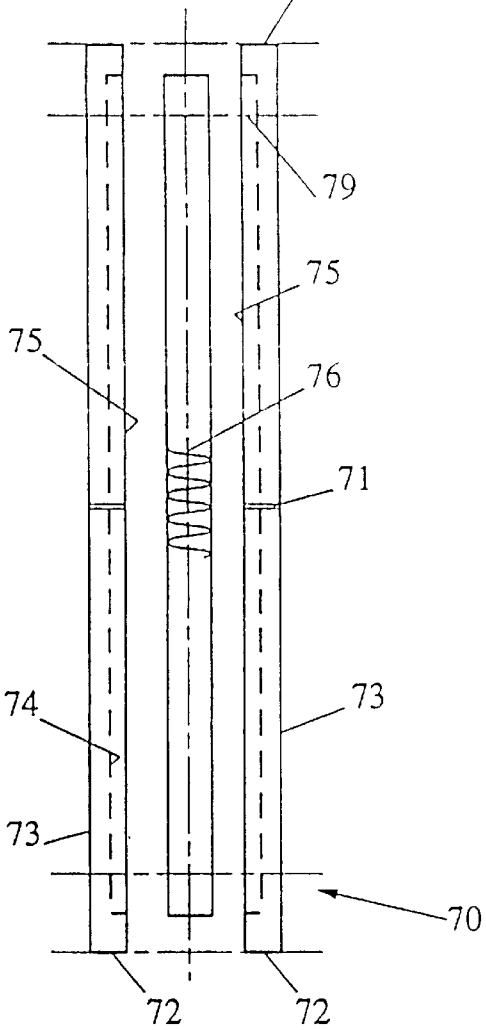
FIGS. 8*a–b* show a side and an exploded elevational view, in enlarged scale, respectively, of a sealing ring pair assembly useable with the rotary valve in accordance with the present invention as illustrated in FIG. 3.
Figure 8A:
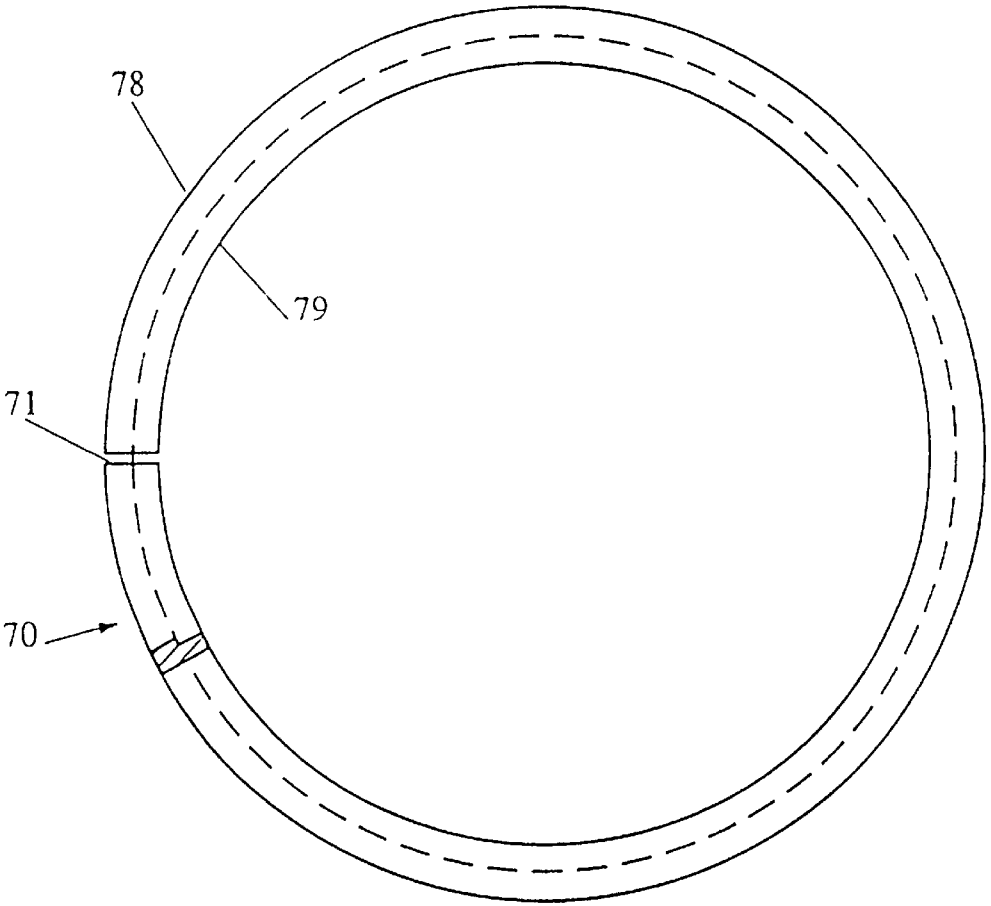

In the embodiment of FIGS. 8*a* and *b* (see also FIG. 6), the two identical sealing rings 72 have a small end gap 71 as discussed above, a planar axial side face 73 and a circular half groove 74 of shallow depth formed in the other axial side face 75. An undulated spring washer 76 is received between the sealing rings 72 and positionally housed within the facing grooves 74.The spring washer 76 serves to bias the rings 72 in opposite axial directions as per arrow (a) and to ensure that the outer planar side faces 73 are preloaded into abutment against the respectively adjoining radially extending side surfaces 62 of the annular groove 60 when received therein (see FIG. 6). A small axial gap 77 is thus formed between the inner (facing) ring side faces 75. The axial width and radial depth of the rings 72 and annular groove 60 are such that the rings 72, which are self-biasing in radially outward direction, maintain a predetermined axial play within the groove 60 when the spring washer 76 is fully compressed (axial gap 77 is closed) and such as to maintain a radial gap (b) between the radially inner circumferential surface 79 of the rings 72 and the groove bottom 61 whilst protruding radially from said annular groove 60 so that the radially outer circumferential surface 78 of the rings is in substantially continuous sliding abutment against the bore surface 15. Thus, the radial clearance gap 52 is bridged in circumferential direction of the rotor 12. The spring constant of the undulating spring washer 76 can be chosen such that the rings 72 are prevented from rotating within the annular groove 60; fixing of the rings 72 against rotation can also be accomplished by a pin member or by appropriately choosing the aspect ratio of the rings 72. Rotational position is fixed such that the ring gap 71 is within the discrete intake surface zone 44*a* (see FIG. 5).

Figure 9C:
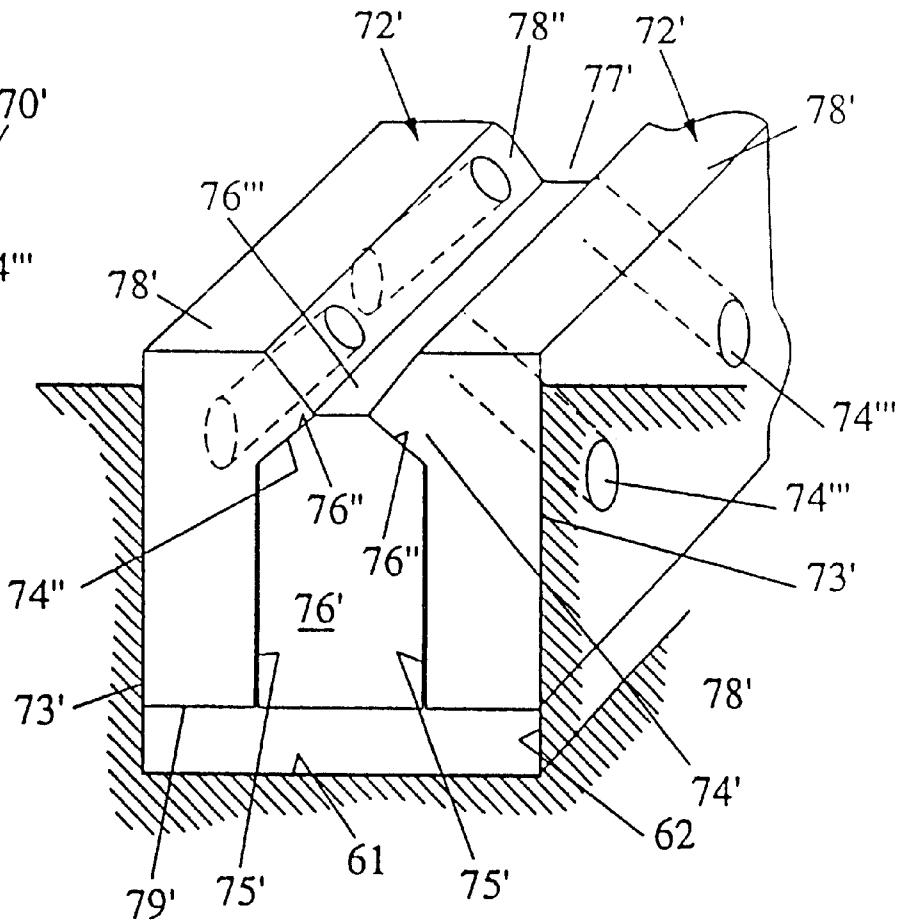
FIGS. 9*a–c* show a side, an elevational and a perspective partial and enlarged view, respectively, of an alternative embodiment of a sealing ring pair assembly useable with the rotary valve in accordance with the present invention (FIG. 9*c* showing the arrangement of the sealing rings within its receiving groove as viewed along arrow IXc in FIG. 9*a*)
Figure 9B:
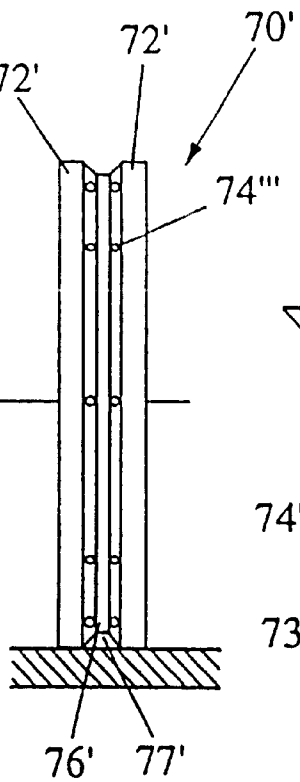
Figure 9A:
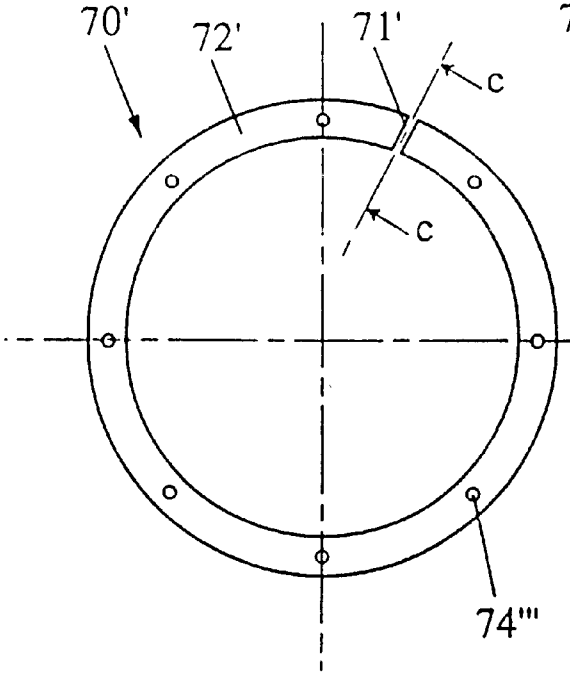

In the embodiment of the annular sealing element 70' of FIGS. 9*a* to 9*c*, each of the two sealing rings 72', which also have a small circumferential end gap 71' as previously described, has formed an annular flange 74' on the respective axial side faces 75' that oppose one another when the rings 72' are pairwise received in the annular groove 60. The flange 74' has a radially inward facing, radially outwardly tapering, annular sealing surface 74". An expansion ring 76' biased to expand radially outwardly and having two in radial outward direction converging annular displacement surfaces 76" is disposed between the two sealing rings 72' such that its displacement surfaces 76" slidingly abut against the sealing surfaces 74" of the sealing rings 72'. This in turn causes the rings 72' to abut with their outer planar side faces 73' in sealing engagement against the respectively adjacent side wall surface 62 of the annular groove 60, as well as in radial direction with the circumferential outer surface 78' against the valve bore surface (not shown in FIG. 7*c*). A lubricant gallery channel 77' is defined between the outer circumferential surface 76'" of the expansion ring 76' and facing inclined side surfaces 78" radially inwardly extending from the outer circumferential surface 78' of the sealing rings 72'. A plurality of circumferentially spaced apart lubricant feeding holes 74'" extend from the outer side faces 73' of the sealing rings 72' to end in the inclined side surfaces 78" facing the lubricant gallery channel 77'. With this embodiment it is possible to introduce small lubricant quantities into the gallery (eg through a feeding bore in the cylinder head that leads into the valve bore at the gallery location, as schematically indicated at 77" in FIG. 2) and from there through the feeding holes 74'" into the abutment zone between the sealing rings 72' and the groove side wall surfaces to enhance sealing efficiency. Frictional wear between the circumferential ring surface 78' and the valve bore surface 15 can also be reduced by the lubricant gallery 79'. A radial gap (b) is again maintained between the groove bottom 61 and the radially inner circumferential surface 79' of the rings 72'.

Turning again to FIGS. 1 to 5, passage of gas from the combustion chamber 22 through the transfer port 20 in a circumferential direction of the rotor body 12 is restricted or limited to the discrete surface zones as they pass over the transfer port by a total of six (6) axially extending sealing elements 80, 90 which are angularly spaced from one another along the circumference of the rotor body surface 44 and received in correspondingly spaced longitudinal grooves 64, 68 extending between the annular grooves 60 at the notional boundary lines between the surface zones 44*a* to 44*f*. In other words, Each discrete surface zone 44*a* to 44*f* has a leading and a trailing longitudinal sealing element, whereby the leading and the trailing longitudinal sealing element is one and the same for adjoining surface zones, noting the overlap surface zone 44*f* defined between the intake and exhaust ports 46, 48. Also, because the leading longitudinal sealing element 80 of the ignition surface zone 44*c* serves a special purpose, a separate reference numeral has been allocated thereto as well as its associated receiving groove 68 in FIGS. 3 and 5.

Figures 7A, 7B, 7C:
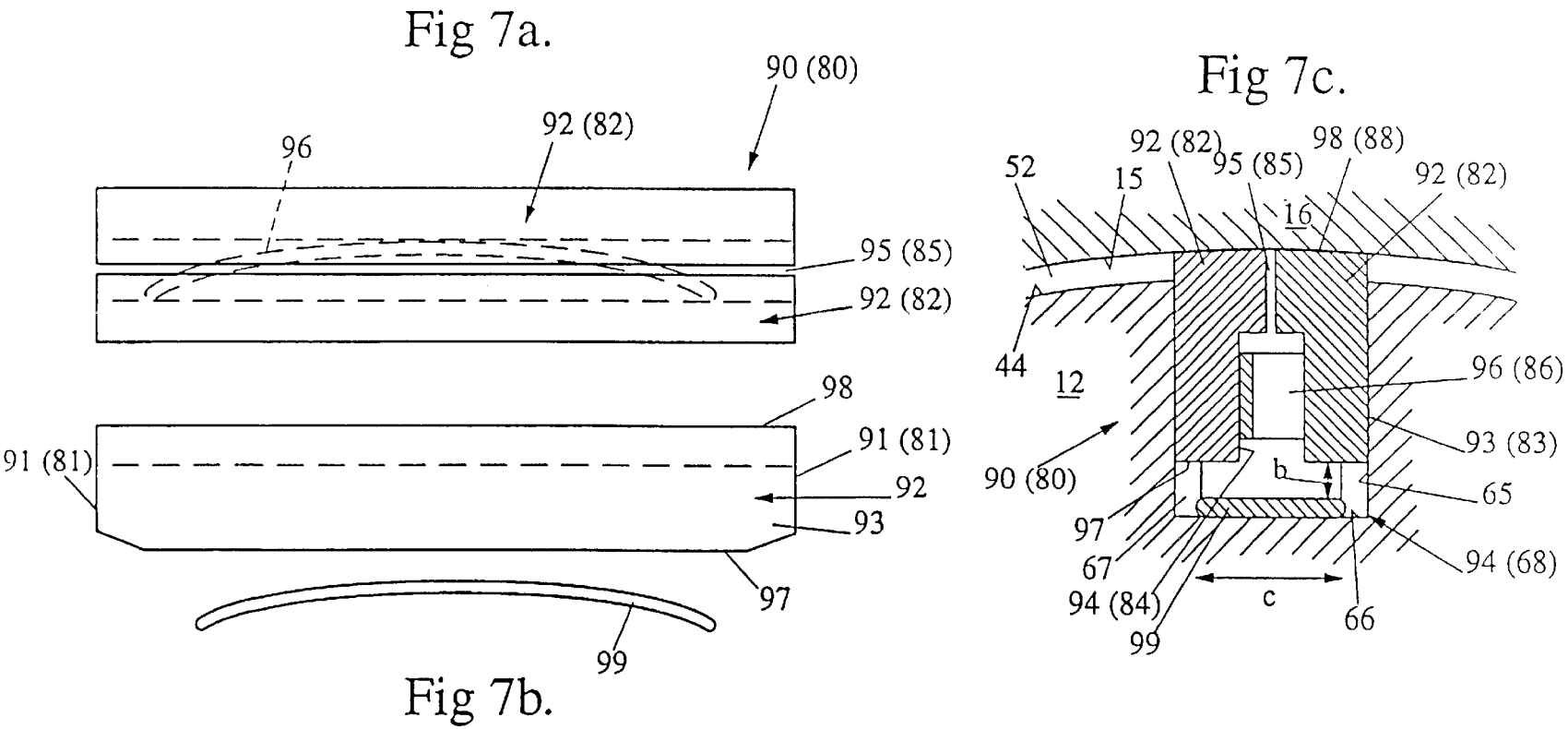

FIGS. 7*a* to 7*c* schematically show a preferred embodiment of the longitudinal sealing element 90. It comprises two axially extending sealing blades 92, L-shaped in cross-section, with the shorter legs extending in circumferential direction of the rotor body 12 when mounted in the longitudinal groove 64. A leaf spring 96 is received between the facing inner surfaces 94 of the longer legs of the sealing blades 92 which are received within the groove 64. The leaf spring 96 ensures that the axial blades 92 are preloaded in circumferentially opposite directions (c) such that the outer surfaces 93 of the longer legs are abutted against the radially and axially extending side wall surfaces 65 of the longitudinal groove 64 as seen in FIG. 7*c*. The circumferential extension of the longitudinal groove 64 is such that when the sealing blades 92 are in abutting relation ship on the side wall surfaces 65, a very small gap 95 in circumferential direction and extending between the facing shorter legs of the blades 72 is maintained (called the longitudinal gap 95). Further, the radial depth of the longitudinal groove 64 and the axial sealing blades 92 is such that a radial gap (b) is maintained between the bottom 66 of the groove and the radially inner surface 97 of the sealing blades 92 whilst the blades protrude radially from said longitudinal groove 64 so that its radially outer engagement surface 98 is in sliding abutment against the valve bore surface 15 to bridge the small radial clearance gap 52 in axial direction of the rotor 12. It should be noted that this engagement surface 98 is arcuate so as to conform with the valve bore surface 15, that is said abutment surface has a radius of curvature corresponding to that of the valve bore. A further leaf spring 99 is located in the groove 64 underneath the axial blades 92 to ensure a preloaded abutting engagement by biasing the blades 92 in radial direction. The longitudinal gap 95 should be maintained as small as possible, and to accommodate manufacturing tolerances it is believed values of 0.01 to 0.02 mm can be accommodated without adversely affecting sealing efficiency, as will be described bellow.

But for the size of the longitudinal gap 95 along the axial extension of the blades 92, the leading sealing element 80 of the ignition zone 44*c* is of similar construction as the sealing element 90 just described. That is, either the shorter legs of the L-cross sectionally shaped axial blades 82 are shorter than those of blades 92, while the width of groove 68 in circumferential direction is the same for all grooves 64, 68, or the width of groove 68 is increased to create an enlarged longitudinal gap 85 for sealing element 80 (see FIG. 5). The longitudinal gap 85 for sealing element 80 should be chosen at 0.25 to 0.5 mm to allow gas passage and pressurisation of the cavity formed bellow the sealing elements (see bellow) within a short period of time.

Figure 6:
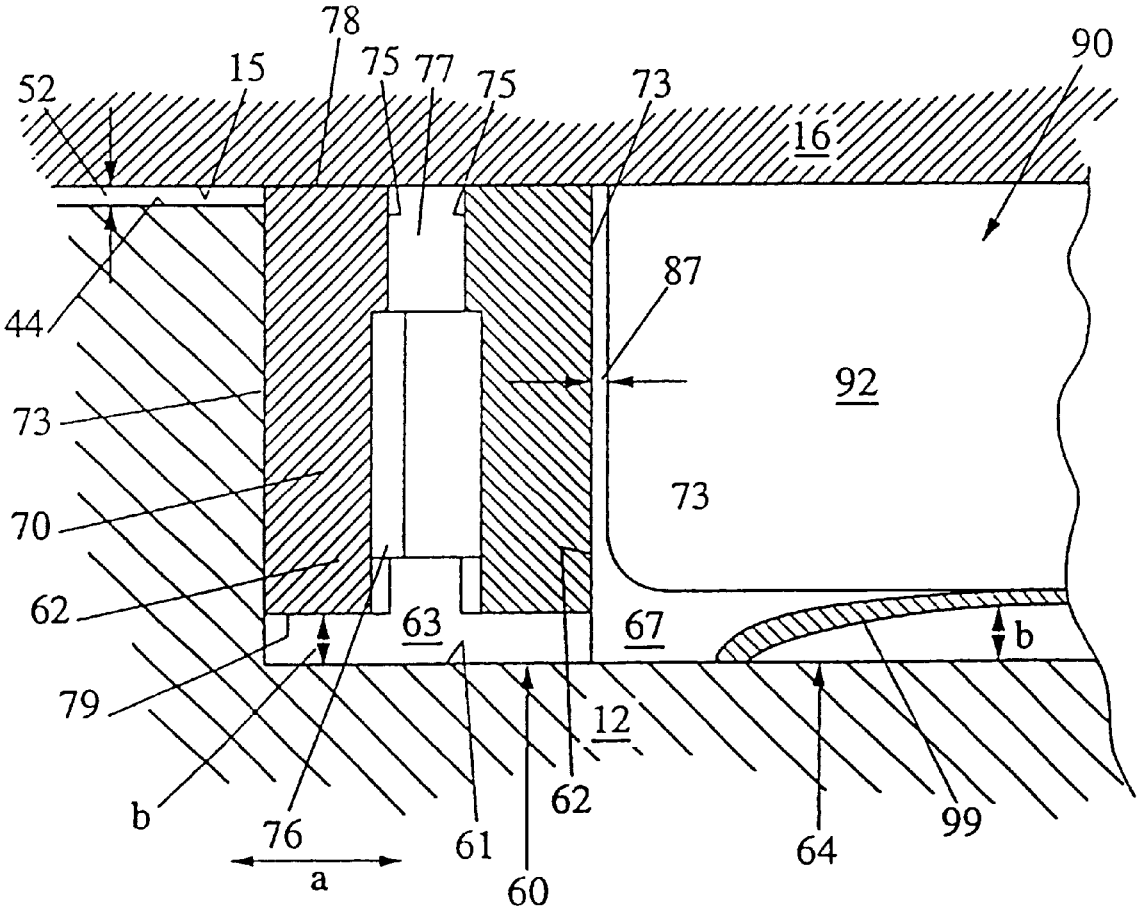
FIG. 6 is a schematic cross sectional enlarged view (not to scale) of an intersection area between a longitudinal sealing element and a sealing ring pair of the rotary valve body of FIG. 3 as indicated by circle VI in FIGS. 3 and 5.

Finally, referring to FIG. 6, which illustrates schematically (and not to scale) an intersection point between annular groove 60 and the longitudinal groove 64 (and respectively therein received sealing elements 70, 90), the radial depth of all grooves 60, 64, 68 is substantially the same at the junctions. Because the grooves 60, 64 and 68 intersect, a grid network of interconnected conduits is formed underneath the sealing elements 70, 80 and 90 because of their clearance (b) to the groove bottoms. (see also FIG. 5, detail C). Each axially extending sealing blade 82 (92) has an axial length such that when received in their respective grooves 64 (68) and abutting with one axial end face 91 against the respectively adjacent sealing ring 72, the other axial end face 91 maintains a small axial gap 87 to the respectively adjacent other one sealing ring 72. The mean value of this axial gap 87 can be set to be 0.025 mm or smaller, since the thermal loads to which all longitudinal sealing elements 80, 90 are exposed are not critical and thermal expansion in axial direction will be minimal (the only critical sealing elements being those at the leading and to a somewhat lesser extent trailing end of the ignition surface zone 44*c*; however, because the only area directly exposed to the combustion temperatures is that bridging the radial gap clearance 52 between rotor surface 44 and valve bore surface 15, and effective air cooling can be provided through said interconnected grid network underneath the sealing elements to the sealing elements, even for those blades it is believed that axial gap clearances of 0.025 mm will allow to accommodate thermal expansion of the blades 82, 92 such that their maximum length is precisely equal to the length of the longitudinal grooves 64, 68).

It will be noted from FIG. 6 that the annular cavity 63 defined between the facing axial side surfaces 75 of the two sealing rings received in groove 60, the radially inner circumferential surfaces 79 of the sealing rings 72, the side and bottom surfaces 61, 62 of the groove 60 bellow the inner circumferential surface 79 (that is the radial clearance space zone b) and the surface 15 of the valve bore against which the outer circumferential surfaces 78 of the sealing rings 72 rub is essentially sealed off. It will be similarly noted from FIG. 7*c* that the longitudinal cavity 67 formed and defined between the facing radially extending side surfaces 94 of the axial blades 92 received within the longitudinal grooves 64, the axially and circumferentially extending surfaces 97 of the axial blades 92 located within the groove 64, the side wall surfaces 65 of the groove 64 bellow said blade bottom surfaces 97, the bottom surface 66 of the groove 64 and the surface 15 of the valve bore against which the radially outer engagement surfaces 98 of the axial blades 92 rub is also essentially sealed off. (Similar considerations apply to sealing element 80). The only locations where a fluid path in and out of these cavities 63, 67 exists is at the ring end gaps 71 of the sealing rings 72, the axial end gaps 87 where the longitudinal sealing elements meet the inner sealing rings 72 and at the intersections between the annular and longitudinal grooves 60, 64 and 68 beneath the sealing elements received therein (because of the radial gap b). A "transitional" fluid path is also given through the longitudinal gap 85, 95 between the sealing blades 82, 92 during the time period they traverse over the transfer port 20 (see FIG. 5).

Accordingly, by directing an adequately pressurised fluid into the cavities 63, 67 between each ring pair 72 and blade pair 82, 92, it is possible to bias or pressurise them beyond the preloading provided by the springs 76, 96 in opposite directions to be maintained abutted on the respectively adjacent side wall surface 62, 65 of the respective grooves 60, 64, 68 in which each sealing element 70, 80, 90 is received against pressure exerted on the portions of these elements 72, 82, 92 that bridge the radial clearance gap 52 between rotor surface 44 and valve bore surface 15 from within the compartmentalised volume zones above the discrete surface zones 44*a* to 44*f*.

In the illustrated embodiment, the pressurised fluid is provided from the cylinder 18 of the engine controlled by the rotary valve 10. The pressurisation gas is directed into the cavities 63, 67 during the compression phase where the piston 28 moves from its BDC towards its TDC prior to ignition of the air-fuel charge in the combustion chamber 22. This is effected during the time period in which the leading longitudinal sealing element 80 of the discrete ignition surface zone 44*c* traverses over the transfer port 20 during rotation of the rotor 12. Upon passing over the transfer port during the compression phase of the operating cycle, compression gases can flow through the longitudinal gal) 85 past the facing radially extending surfaces 84 of the blades 82 into the zone between the groove bottom 66 and the lower surfaces 87 of the blades 82 received within the groove 68 (the longitudinal pressurising cavity 67), from where it will flow in opposite axial directions into the annular pressurising cavities 63 of the annular sealing elements 70, while simultaneously further biasing the axial blades 82 in circumferentially opposite directions to be maintained in "sealing band" abutment against the respective side wall surfaces 65 of the longitudinal groove 68. The pressure level in the longitudinal pressurising cavity 67 will follow that within the combustion chamber 22 as It increases during the compression stroke and while the leading sealing element 80 passes over the transfer port 20. Pressure increase will be cut off once the longitudinal gap 85 clears the transfer port 20 and is sealed off by the valve bore surface 15. This pressurisation of the annular and longitudinal cavities 63 and 67 is illustrated in FIG. 10 by the chain dotted line.

As was discussed above in the summary of invention, the pressurisation level required to maintain the sealing blades 82, 92 (in particular the "trailing" blade 82 of the leading sealing element 80 closest to the transfer port 20) in abutment against the side wall surfaces 65 of the groove 64, 68 against the ignition pressure present in the sealingly framed clearance gap volume over the discrete ignition surface zone 44*c* is only a fraction of the maximum ignition pressure. Thus, once the longitudinal gap 85 clears the trailing edge of the transfer port, the sealing element 80 will prevent ignition gases from entering the longitudinal groove 68 and from there into the annular pressurising cavities 63.

Whilst there is the very small axial end gap 87 at the points where the axial end faces 91, 81 of the axial sealing blades 82, 92 intersect (more appropriately: adjoin or meet) the radially extending side faces 73 of the inner sealing rings 72 (as was discussed above), and therefore a potential gas leakage path from the sealingly framed clearance gap volume over the discrete ignition surface 44*c* into the grooves 60, 64, 68 exists, it is believed that due to its small size, eg max 0.025 mm, which is 1/10 of that of a piston type sealing ring, the pressurisation of the longitudinal pressurising cavity 67, and the substantial gas flow velocities and pressure differentials present at and immediately following ignition, any potential leakage that could take place at this intersection points will not take place at all or almost spontaneously be cut off. It should also be noted that because the longitudinal gap 95 of the trailing longitudinal sealing element of the ignition surface zone 44*c* is very much smaller than that of the leading sealing element 80 (eg 0.025 mm as compared to 0.25 mm), gas leakage into this gap will be minimal, if at all, while it traverses over the transfer port 20, notwithstanding the positive pressure differential between the combustion chamber 22 and the pressuring cavity 67 of the trailing sealing element 90.

It will be noted from FIG. 10 that there is a steady but slow pressure level drop in the interconnected pressurising cavities 63, 67 from the moment pressurisation is cut off (see above) to the time in which the leading sealing element 80 of the discrete ignition surface zone 44*c* is again traversed over the transfer port 20 during rotation of the rotor 12 (thereby recharging the cavities 63, 67 as described above). This drop is due to leakage paths past the ring end gaps 71 of the sealing rings 72 mainly (but also as a result of the longitudinal sealing elements 90 passing over the transfer port 20 during phases of the operating cycle in which the pressure differential between combustion chamber 22 and pressurising cavities 67 could induce leakage past the narrow but axially extensive longitudinal gap 95 (0.025 mm) of the sealing elements 90). The initial pressurisation level of about 12 bar will effectively seal-off the cavities 63, 67 against ingress of combustion gases at peak pressure levels as high as 75 to 80 bar.

Accordingly, this sealing system and pressurisation mechanism ensures that the sealing rings 72 located closest to the transfer port 20 ("the inner rings") at the axial ends of the discrete surface zones 44*a* to 44*f* are maintained during the above described ignition phase in surface abutment against the annular groove side wall surfaces 62 against which they are preloaded by the spring washers 76. This will provide an effective "annular sealing band" preventing high pressure gases, in particular combustion gases, from breaking this sealing band. This in turn ensures that the transfer port 20 is fluidly isolated from the annular grooves 60 during the ignition phase and substantially minimises fluid leakage during this phase from the gap cavity defined between those portions of the sealing rings 72 closest to the transfer port 20 and of the leading and trailing longitudinal sealing elements 80, 90 of the discrete ignition surface zone 44*c* that bridge the radial clearance gap 52, and the facing surfaces 15 and 44 of the bore 14 and the main body portion 40 of the rotor 12.

It will be appreciated by persons skilled in the art that it is possible to use an external pressurisation source (as compared to that provided by the cylinder) as was described above after the summary of invention, and that numerous variations and/or modifications may be made to the above described preferred embodiment of the invention without departing from the scope of the invention as broadly described in the summary of invention. The embodiment illustrated in the figures is, therefore, to be considered in all respects exemplary but not restrictive of the invention The claims defining the invention are as follows:

1. Rotary valve for an internal combustion engine, comprising:

a rotor housing having an axial bore and a transfer port arranged to provide fluid communication between the bore and a combustion chamber of the engine;

a valve rotor supported for rotation within the bore, the rotor having a cylindrical main body portion which maintains a predetermined small radial clearance gap to the bore surface and having at least one fluid exchange duct terminating in an exchange port on an outer peripheral surface of the main body portion, the rotor, in use periodically enabling and preventing fluid exchange through the duct in accordace with the operating cycle of the engine;

and a sealing system, including a set of sealing rings disposed on axially opposite sides of the transfer and the exchange ports and received pairwise in respective single annular grooves formed on either one of the main body portion and within the bore, the rings and grooves being dimensioned such that the rings are received with predetermined axial play between themselves and a radial gap is formed above the groove bottom whilst the rings protrude radially from said annular grooves and either one of the radially outer and the radially inner circumferential surface of the rings is in substantially continuous sliding abutment against either one of the bore surface and peripheral surface of the main body portion, thereby bridging said radial clearance gap in circumferential direction of the rotor, two first longitudinal sealing elements received one each in a corresponding longitudinal groove formed on either one of circumferentially opposite sides close to the transfer port within the bore and on circumferentially opposite sides of a discrete ignition surface zone of the main body portion which, in operation of the valve, covers the transfer port during the ignition phase of combustion fluids in the combustion chamber, the first sealing elements protruding radially from said longitudinal grooves into sliding abutment against either one of the bore surface and peripheral surface of the main body portion, thereby bridging said radial clearance gap in axial direction of the rotor, the first sealing elements having a length such as to be received between the sealing rings closest to the transfer port with either one of a predetermined small axial clearance and play fit; and a pressurising system including a pressurised fluid source and conduits arranged and disposed such as to selectively direct a pressurised fluid in between each ring pair thereby to bias, at least during the ignition phase, the rings in axially opposite directions to abut against a respectively adjacent side wall of the annular grooves in which the sealing ring pairs are received, substantially isolate the transfer port from the annular grooves during the ignition phase and substantially minimise fluid leakage during this phase from the gap cavity defined between the portions of the sealing rings closest to the transfer port and of the first sealing elements that bridge the radial gap, and the facing surfaces of the bore and the main body portion.

2. Rotary valve according to claim 1, wherein both the annular and longitudinal grooves are formed on the cylindrical main portion of the rotor.

3. Rotary valve according to claim 1, the main body portion comprising separate fluid intake and fluid exhaust ducts respectively commencing on axially opposite sides of the main body portion and terminating in an intake arid an exhaust port which are spaced apart in circumferential direction on the outer peripheral surface of the main body portion; and wherein the valve further comprises a plurality of second longitudinal sealing elements received one each in a corresponding one of a plurality of additional longitudinal grooves on the peripheral surface of the main body portion, said second sealing elements disposed to provide a leading and a trailing sealing element for the intake port, a leading and a trailing sealing element for a discrete surface zone associable with the compression phase of the operating cycle, the leading and the trailing sealing element for the discrete ignition surface zone being provided by said first sealing elements, an optional leading and a trailing sealing element for a discrete surface zone associable with the expansion phase of the operating cycle, a leading and a trailing sealing element for the exhaust port, thereby forming at least four discretely framed gap cavities over the discrete surface zones associable with the operating phases of the engine and which rotate with the rotor.

4. A rotary valve according to claim 3, wherein the trailing sealing element of the intake port, the trailing sealing element of the surface zone associable with the ignition phase and the trailing sealing element of the surface zone associable with the expansion phase provide the leading sealing element of the surface zone associable with the compression phase, the optional leading sealing element of the surface zone associable with the expansion phase and the leading sealing element of the exhaust port, respectively.

5. Rotary valve according to claim 3, wherein at least the leading first longitudinal sealing element for the discrete ignition surface zone and optionally selected ones of the remaining first and second longitudinal sealing elements consist each of a pair of axial sealing blades received in parallel with predetermined play in circumferential direction in the corresponding axially extending longitudinal grooves formed on the main body portion;

and wherein the pressurising system includes conduits disposed such as to direct the pressurised fluid in between each sealing blade pair thereby to bias the blades in circumferentially opposite directions to abut against a respectively adjacent side wall of the longitudinal groove in which each sealing blade pair is received, the pressure level imparted on the fluid and the timing of pressurisation being such that the blades are maintained in abutment against the respective side wall at least during the ignition phase of the operating cycle of the engine.

6. Rotary valve according to claim 2, further comprising sealing ring biasing means arranged to bias the rings in radial direction so as to maintain sliding contact against the bore surface.

7. Rotary valve according to claim 6, wherein the sealing rings are piston rings with a predetermined ring end gap.

8. Rotary valve according to claim 6, wherein the sealing rings are piston rings with overlapping ring ends.

9. Rotary valve according to claim 6, wherein the sealing ring biasing means comprise radially expandable sealing rings.

10. Rotary valve according to claim 1, further comprising sealing ring distance keeping means arranged to maintain an axial gap between the sealing rings when received in the annular groove.

11. Rotary valve according to claim 10, wherein the sealing ring distance keeping means comprise axial biasing means arranged to maintain the rings in abutment against the respectively adjacent side wall of the annular groove in which each sealing ring pair is received.

12. Rotary valve according to claim 11, wherein the sealing ring distance keeping means comprises either one of a conical and undulating spring washer.

13. Rotary valve according to claim 11, wherein a spreading ring is arranged between the sealing rings in each groove, the spreading ring being trapezoidal in radial cross-section, and which co-operates with correspondingly shaped inclined portions of the radially extending side faces of the sealing rings that face the spreading ring, thereby to simultaneously bias the sealing rings in radial and in axially opposite directions into sealing engagement with the valve bore surface and the side wall surfaces of the annular groove.

14. Rotary valve according to claim 13, wherein a lubricant gallery channel is defined between an outer circumferential surface of the spreading ring and channel side surfaces formed on the facing side surfaces of the sealing rings.

15. Rotary valve according to claim 14, wherein a plurality of circumferentially spaced apart lubricant feeding holes extend from one of the side faces of the sealing rings to end in one of the side surfaces of the lubricant gallery channel.

16. Rotary valve according to claim 1, further comprising sealing blade biasing means arranged to bias the blades in radial direction so as to maintain sliding contact against the bore surface.

17. Rotary valve according to claim 16, wherein the sealing blade biasing means comprise a leaf spring received in the longitudinal groove below the sealing blades.

18. Rotary valve according to claim 16, further comprising sealing blade distance keeping means arranged to maintain a longitudinally extending gap between the sealing blades when received in the associated longitudinal groove.

19. Rotary valve according to claim 18, wherein the sealing blade distance keeping means comprise circumferentially acting biasing means arranged to maintain the blades in abutment against the respectively adjacent side wail of the longitudinal groove in which each sealing blade pair is received.

20. Rotary valve according to claim 19, wherein the sealing blade distance keeping means comprises either one of a leaf and undulated band spring.

21. Rotary valve according to claim 1, wherein the pressurised fluid source is a pressurised air source.

22. Rotary valve according to claim 21, wherein the pressurised air source is either one of a compressor and turbo charger of the engine.

23. Rotary valve according to claim 21, wherein the pressurised air source is an intake manifold of the engine whilst under positive pressure.

24. Rotary valve according to claim 21, wherein the pressurised air source is a cylinder of the engine in which a piston reciprocates in accordance with the operating cycle of the engine.

25. Rotary valve according to claim 24, wherein the pressurised air source is in fluid communication with the conduits during at least part of the compression phase of the operating cycle of the engine.

26. Rotary valve according to claim 1, wherein the pressurised fluid is a cooling fluid for the sealing elements.

27. Rotary valve according to claim 3, wherein the annular grooves for the sealing rings and at least the longitudinal groove for the leading first sealing element for the ignition surface zone are in fluid communication with one another when the respective sealing rings and elements are received therein, said grooves being either one of forming part of and being the conduits.

28. Rotary valve according to claim 3, wherein the annular grooves for the sealing rings and all the longitudinal grooves for the longitudinal sealing elements are in fluid communication with one another when the respective sealing rings and elements are received therein, said grooves being either one of forming part of and being a network of interconnected conduits;

and wherein the first and second longitudinal sealing elements consist each of a pair of axial sealing blades received in parallel with predetermined play in circumferential direction in the corresponding axially extending longitudinal grooves formed on the main body portion;

the pressurising system disposed to direct the pressurised fluid in between each sealing blade pair thereby to bias the blades in circumferentially opposite directions to abut against a respectively adjacent side wall of the longitudinal groove in which each sealing blade pair is received, the pressure level imparted on the fluid and the timing of pressurisation being such that the blades are maintained in abutment against the respective side wall during operating cycle of the engine.

* * * * *

UNITED STATES PATENT AND TRADEMARK OFFICE

CERTIFICATE OF CORRECTION

PATENT NO. : 6,237,556 B1
DATED : May 29, 2001
INVENTOR(S) : Brian Smith and Wayne Smith It is certified that error appears in the above-identified patent and that said Letters Patent is hereby corrected as shown below:

Column 4,
Line 19, "tie" should read -- be --.

Column 15,
Line 50, there should be a paragraph indicated at "Turning".

Column 19,
Line 18, "words. Each" should read -- words, each --.

Column 21,
Line 27, "gal" should read -- gap --.
Line 39, "It" should read -- it --.

Column 23, claim 3,
Line 4, "arid" should read -- and --.

Signed and Sealed this

Eighteenth Day of December, 2001

*Attest:*

*Attesting Officer*

JAMES E. ROGAN
*Director of the United States Patent and Trademark Office*